US012693059B2

(12) United States Patent
Kami et al.

(10) Patent No.: US 12,693,059 B2
(45) Date of Patent: Jul. 28, 2026

(54) HEAT PUMP CYCLE DEVICE

(71) Applicant: DENSO CORPORATION, Kariya-city (JP)

(72) Inventors: Yuichi Kami, Kariya-city (JP); Kota Takeichi, Kariya-city (JP)

(73) Assignee: DENSO CORPORATION, Kariya-city (JP)

( * ) Notice: Subject to any disclaimer, the term of this patent is extended or adjusted under 35 U.S.C. 154(b) by 298 days.

(21) Appl. No.: 18/642,281

(22) Filed: Apr. 22, 2024

(65) Prior Publication Data

US 2024/0271844 A1 Aug. 15, 2024

Related U.S. Application Data

(63) Continuation of application No. PCT/JP2022/037630, filed on Oct. 7, 2022.

(30) Foreign Application Priority Data

Oct. 25, 2021 (JP) ..... 2021-173703

(51) Int. Cl.

| | |
|---|---|
| ***F25B 49/02*** | (2006.01) |
| ***F25B 30/02*** | (2006.01) |
| ***F25B 41/20*** | (2021.01) |

(52) U.S. Cl.

CPC ..... *F25B 49/02* (2013.01); *F25B 30/02* (2013.01); *F25B 41/20* (2021.01); *F25B 2400/04* (2013.01)

(58) Field of Classification Search

CPC ..... F25B 49/02; F25B 41/20; F25B 30/02; F25B 2400/04

See application file for complete search history.

(56) References Cited

U.S. PATENT DOCUMENTS

| | | | | |
|---|---|---|---|---|
| 2013/0055751 | A1 | 3/2013 | Inaba | |
| 2016/0082810 | A1 | 3/2016 | Suzuki | |
| 2016/0377303 | A1* | 12/2016 | Staffend | F01C 13/04 165/45 |

(Continued)

FOREIGN PATENT DOCUMENTS

| | | | |
|---|---|---|---|
| EP | 2581689 | A1 | 4/2013 |
| EP | 2853838 | A1 | 4/2015 |
| JP | 2005-075102 | A | 3/2005 |

(Continued)

*Primary Examiner* — Nael N Babaa

(74) *Attorney, Agent, or Firm* — Harness, Dickey & Pierce, PLC

(57) ABSTRACT

A heat pump cycle device includes a compressor, a branch part, a heating unit, a heating-unit side decompression unit, a bypass passage, a bypass flow rate adjustment unit, a mixing part, a target temperature determination part configured to determine a target temperature that is a target value of an object temperature of the heating object heated by the heating unit, and a target low-pressure determination part configured to determine a target low pressure that is a target value of a sucked refrigerant pressure of the refrigerant to be sucked into the compressor. When the object temperature is lower than the target temperature during execution of a hot gas mode, a high-pressure rise control is performed to raise a discharged refrigerant pressure of the refrigerant flowing into the heating unit.

9 Claims, 9 Drawing Sheets

(56) References Cited

U.S. PATENT DOCUMENTS

| | | | | |
|---|---|---|---|---|
| 2019/0310000 | A1* | 10/2019 | Shan | F25B 49/02 |
| 2022/0275982 | A1 | 9/2022 | Mieda et al. | |

FOREIGN PATENT DOCUMENTS

| | | | |
|---|---|---|---|
| JP | 2011-027372 | A | 2/2011 |
| JP | 2011257100 | A | 12/2011 |
| JP | 2013068407 | A | 4/2013 |
| JP | 2014226979 | A | 12/2014 |
| JP | 2015064169 | A | 4/2015 |
| JP | 2015128926 | A | 7/2015 |
| JP | 2019090595 | A | 6/2019 |
| JP | 2021156567 | A | 10/2021 |

* cited by examiner

HOT GAS HEATING MODE

HOT GAS DEHUMIDIFICATION HEATING MODE

HOT GAS HEATING MODE

HEAT PUMP CYCLE DEVICE

CROSS REFERENCE TO RELATED APPLICATION

The present application is a continuation application of International Patent Application No. PCT/JP2022/037630 filed on Oct. 7, 2022, which designated the U.S. and claims the benefit of priority from Japanese Patent Application No. 2021-173703 filed on Oct. 25, 2021. The entire disclosures of all of the above applications are incorporated herein by reference.

TECHNICAL FIELD

The present disclosure relates to a heat pump cycle device that heats a heating object using heat generated by the work of a compressor.

BACKGROUND

Conventionally, a heat pump cycle device may be applied to a vehicle air conditioner. For example, the heat pump cycle device may execute an operation in a non-frost mode when frost has been formed in an outdoor heat exchanger. In the non-frost mode, a refrigerant circuit may be switched, so that refrigerant discharged from a compressor is circulated through a high-pressure side refrigerant passage of an internal heat exchanger on a discharge side, a radiator, an expansion valve, a low-pressure side refrigerant passage of the internal heat exchanger on the discharge side, an accumulator, and a suction port of the compressor in this order.

As a result, in the non-frost mode of the heat pump cycle device, the low-pressure refrigerant is prevented from evaporating in the internal heat exchanger when frost has been formed in the outdoor heat exchanger, whereby the progress of frost formation in the outdoor heat exchanger is suppressed.

SUMMARY

A heat pump cycle device according to an aspect of the present disclosure includes a compressor, a branch part, a heating unit, a heating-unit side decompression unit, a bypass passage, a bypass flow rate adjustment unit, a mixing part, a target temperature determination part, and a target low-pressure determination part.

The compressor is configured to compress and discharge a refrigerant. The branch part is configured to branch a flow of the refrigerant discharged from the compressor. The heating unit is configured to heat a heating object using one stream of the refrigerants branched at the branch part as a heat source. The heating-unit side decompression unit is configured to decompress the refrigerant flowing out of the heating unit. The bypass passage is configured to guide the other stream of the refrigerants branched at the branch part to a suction port side of the compressor. The bypass flow rate adjustment unit is configured to adjust a flow rate of the refrigerant flowing through the bypass passage. The mixing part is configured to mix the refrigerant flowing out of the bypass flow rate adjustment unit with the refrigerant flowing out of the heating-unit side decompression unit, and to cause the mixed refrigerant to flow to the suction port side of the compressor. The target temperature determination part is configured to determine a target temperature that is a target value of an object temperature of the heating object heated by the heating unit. Furthermore, the target low-pressure determination part is configured to determine a target low pressure that is a target value of a sucked refrigerant pressure of the refrigerant to be sucked into the compressor.

A hot gas mode may be performed as an operation mode for heating the heating object. In the hot gas mode, an operation of at least one of the compressor, the heating-unit side decompression unit, and the bypass flow rate adjustment unit is controlled such that the object temperature approaches the target temperature and the sucked refrigerant pressure approaches the target low pressure.

When the object temperature is lower than the target temperature during execution of the hot gas mode, a high-pressure rise control is performed to increase a discharged refrigerant pressure of the refrigerant flowing into the heating unit.

BRIEF DESCRIPTION OF DRAWINGS

The above object and other objects, features, and advantages of the present disclosure will become more apparent from the following detailed description with reference to the accompanying drawings. In the drawings.

DESCRIPTION OF EMBODIMENTS

Figure 1:
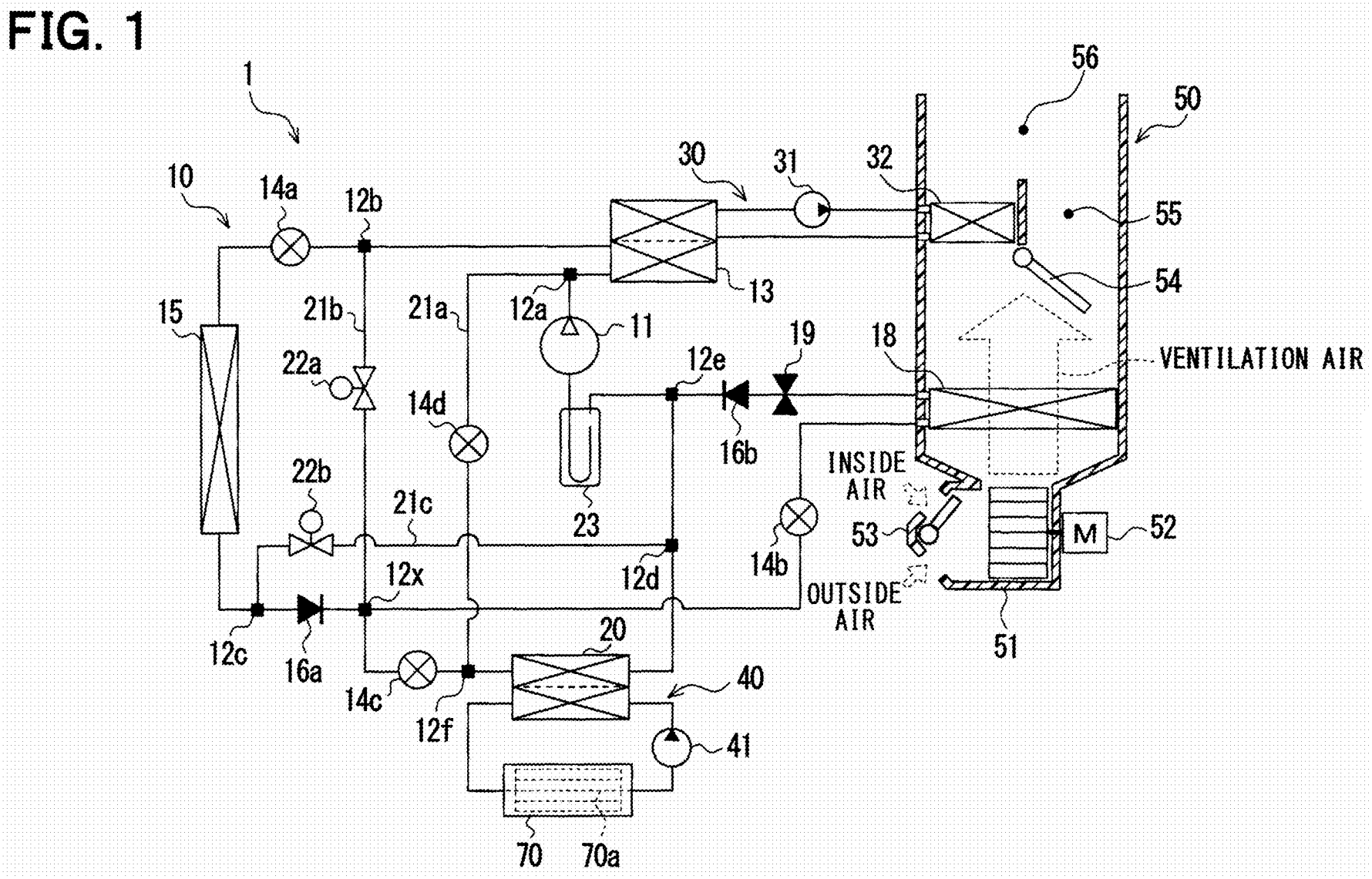
FIG. 1 is a schematic overall configuration diagram of a vehicle air conditioner according to a first embodiment.

A heat pump cycle device of a first example may execute an operation in a non-frost mode when frost has been formed in an outdoor heat exchanger. In the non-frost mode of the first example, a refrigerant circuit is switched, in which a refrigerant discharged from a compressor is circulated through a high-pressure side refrigerant passage of an internal heat exchanger on a discharge side, a radiator, an expansion valve, a low-pressure side refrigerant passage of the internal heat exchanger on the discharge side, an accumulator, and a suction port of the compressor in this order.

As a result, in the non-frost mode of the heat pump cycle device of the first example, the low-pressure refrigerant is prevented from evaporating in the internal heat exchanger when frost has been formed in the outdoor heat exchanger, whereby the progress of frost formation in the outdoor heat exchanger is suppressed. Furthermore, the heat of the refrigerant, flowing out of the high-pressure side refrigerant passage of the internal heat exchanger on the discharge side, is exchanged with the heat of ventilation air to be blown into a vehicle interior, whereby the heating of the vehicle interior is continued.

That is, in the non-frost mode of the heat pump cycle device of the first example, the ventilation air, which is a heating object, is heated using the heat generated by the work of the compressor, without using the heat absorbed from outside air or the like.

In the non-frost mode of the heat pump cycle device of the first example, however, the internal heat exchanger on the discharge side exchanges heat between the discharged refrigerant discharged from the compressor and the sucked refrigerant to be sucked into the compressor. Therefore, the enthalpy of the refrigerant to flow into the radiator decreases, and the heat generated by the work of the compressor cannot be effectively used to heat the ventilation air.

On the other hand, a heat pump cycle device of a second example is made to be capable of heating a heating object using the heat generated by the work of a compressor without using the heat absorbed from outside air or the like. The heat pump cycle device of the second example is capable of effectively using the heat generated by the work of a compressor to heat the heating object.

In the heat pump cycle device of the second example, the flow of the refrigerant discharged from the compressor is branched, and one of the branched refrigerants is caused to flow into a heating unit. The heating unit exchanges heat between the refrigerant and the heating object, whereby the heating object is heated. Furthermore, the refrigerant flowing out of the heating unit is decompressed by a heating-unit side decompression unit. The other of the branched refrigerants is decompressed by a bypass side flow rate adjustment valve disposed in a bypass passage. The refrigerant decompressed by a heating-unit side decompression unit and the refrigerant decompressed by a bypass side flow rate adjustment valve are mixed and sucked into the compressor.

In the heat pump cycle device of second example, the discharged refrigerant with high enthalpy discharged from the compressor may flow into the heating unit, so that the heat generated by the work of the compressor can be effectively used to heat the heating object.

In the heat pump cycle device of the second example, however, both a discharged refrigerant pressure and a sucked refrigerant pressure are necessary to be adjusted such that, the workload of the compressor becomes an appropriate amount of heat for heating the heating object in order to stabilize the operation of the cycle. Therefore, in the heat pump cycle device of the second example, the temperature of the heating object cannot be raised to a desired temperature if the discharged refrigerant pressure cannot be sufficiently raised, and a temperature adjustment range for the heating object may become narrowed.

In view of the above, an object of the present disclosure is to provide a heat pump cycle device capable of expanding a temperature adjustment range for a heating object.

A heat pump cycle device according to an aspect of the present disclosure includes a compressor, a branch part, a heating unit, a heating-unit side decompression unit, a bypass passage, a bypass flow rate adjustment unit, a mixing part, a target temperature determination part, and a target low-pressure determination part.

The compressor is configured to compress and discharge a refrigerant. The branch part is configured to branch a flow of the refrigerant discharged from the compressor. The heating unit is configured to heat a heating object using one stream of the refrigerants branched at the branch part as a heat source. The heating-unit side decompression unit is configured to decompress the refrigerant flowing out of the heating unit. The bypass passage is configured to guide the other stream of the refrigerants branched at the branch part to a suction port side of the compressor. The bypass flow rate adjustment unit is configured to adjust a flow rate of the refrigerant flowing through the bypass passage. The mixing part is configured to mix the refrigerant flowing out of the bypass flow rate adjustment unit with the refrigerant flowing out of the heating-unit side decompression unit, and to cause the mixed refrigerant to flow to the suction port side of the compressor. The target temperature determination part is configured to determine a target temperature that is a target value of an object temperature of the heating object heated by the heating unit. Furthermore, the target low-pressure determination part is configured to determine a target low pressure that is a target value of a sucked refrigerant pressure of the refrigerant to be sucked into the compressor.

A hot gas mode may be performed as an operation mode for heating the heating object. In the hot gas mode, an operation of at least one of the compressor, the heating-unit side decompression unit, and the bypass flow rate adjustment unit is controlled such that the object temperature approaches the target temperature and the sucked refrigerant pressure approaches the target low pressure.

When the object temperature is lower than the target temperature during execution of the hot gas mode, a high-pressure rise control is performed to raise a discharged refrigerant pressure of the refrigerant flowing into the heating unit.

According to this, when the object temperature is equal to or lower than the target temperature during the execution of the hot gas mode, the high-pressure rise control is performed, so that the discharged refrigerant pressure can be raised. Accordingly, the discharged refrigerant temperature of a refrigerant, that serves a heat source for heating the heating object in the heating unit, can be raised. As a result, in the heat pump cycle device according to the above aspect of the present disclosure, a temperature adjustment range for the heating object can be enlarged.

Hereinafter, a plurality of embodiments for carrying out the present disclosure will be described with reference to the drawings. In each embodiment, parts corresponding to the matters described in the preceding embodiments are denoted by the same reference numerals, and redundant description may be omitted. In a case where only a part of a configuration is described in each embodiment, the other embodiments described precedingly can be applied to the other parts of the configuration. It is possible not only to combine parts that respective embodiments explicitly state that they can be combined, but also to partially combine embodiments even if not explicitly stated as long as there are no problems with the combination.

First Embodiment

A first embodiment of a heat pump cycle device according to the present disclosure will be described with reference to FIGS. 1 to 8. In the present embodiment, the heat pump cycle device according to the present disclosure is applied to a vehicle air conditioner 1 mounted on an electrical vehicle. The electrical vehicle is a vehicle that obtains driving force for traveling from an electric motor. The vehicle air conditioner 1 performs air conditioning of a vehicle interior, which is a space to be air-conditioned, and adjusts the temperature of in-vehicle equipment. Accordingly, the vehicle air conditioner 1 can be referred to as an air conditioner with an in-vehicle equipment temperature adjustment function or an in-vehicle equipment temperature adjustment device with an air conditioning function.

The vehicle air conditioner 1 specifically adjusts the temperature of a battery 70 as the in-vehicle equipment. The battery 70 is a secondary battery that stores electric power to be supplied to a plurality of the in-vehicle equipment operated by electricity. The battery 70 is an assembled battery formed by electrically connecting a plurality of stacked battery cells in series or in parallel. The battery cells of the present embodiment are lithium ion batteries.

The battery 70 generates heat during operation (i.e., during charging and discharging). The output of the battery 70 is likely to decrease at a low temperature, and deterioration is likely to progress at a high temperature. Therefore, the temperature of the battery 70 needs to be maintained within an appropriate temperature range (in the present embodiment, 15° C. or higher and 55° C. or lower). Therefore, in the electrical vehicle of the present embodiment, the temperature of the battery 70 is adjusted using the vehicle air conditioner 1. Of course, the in-vehicle equipment whose temperatures are to be adjusted by the vehicle air conditioner 1 are not limited to the battery 70.

The vehicle air conditioner 1 includes a heat pump cycle 10, a high-temperature side heat medium circuit 30, a low-temperature side heat medium circuit 40, an indoor air conditioning unit 50, a control device 60 (i.e., controller), and the like.

First, the heat pump cycle 10 will be described. The heat pump cycle 10 is a vapor compression refrigeration cycle that adjusts the temperatures of ventilation air to be blown into a vehicle interior, a high-temperature side heat medium circulating in the high-temperature side heat medium circuit 30, and a low-temperature side heat medium circulating in the low-temperature side heat medium circuit 40. In order to air condition the vehicle interior and to cool the in-vehicle equipment, the heat pump cycle 10 is configured to be able to switch refrigerant circuits in accordance with various operation modes to be described later.

In the heat pump cycle 10, an HFO refrigerant (specifically, R1234yf) is adopted as a refrigerant. The heat pump cycle 10 constitutes a subcritical refrigeration cycle in which the pressure of a high-pressure side refrigerant does not exceed the critical pressure of the refrigerant. Refrigerating machine oil for lubricating a compressor 11 is mixed in the refrigerant. The refrigerating machine oil is PAG oil (i.e., polyalkylene glycol oil) having compatibility with a liquid-phase refrigerant. A part of the refrigerating machine oil circulates in the heat pump cycle 10 together with the refrigerant.

The compressor 11 sucks, compresses, and discharges the refrigerant in the heat pump cycle 10. The compressor 11 is an electric compressor that rotationally drives a fixed capacity type compression mechanism having a fixed discharge capacity by the electric motor. The rotation speed (i.e., refrigerant discharge capability) of the compressor 11 is controlled by a control signal output from the control device 60 to be described later.

The compressor 11 is disposed in a driving device room formed on the front side of the vehicle interior. The driving device room forms a space where at least a part of equipment (e.g., an electric motor for traveling) or the like, that is used to generate or adjust a driving force for vehicle traveling, is disposed.

The inflow port side of a first three-way joint 12*a* (i.e., first three-way) is connected to the discharge port of the compressor 11. The first three-way joint 12*a* has three inflow-outlets communicating with each other. As the first three-way joint 12*a*, a joint part formed by joining a plurality of pipes, or a joint part formed by providing a plurality of refrigerant passages in a metal block or a resin block, can be adopted.

As described later, the heat pump cycle 10 further includes a second three-way joint 12*b* (e.g., second three-way valve) to a sixth three-way joint 12*f*. The basic configurations of the second three-way joint 12*b* to the sixth three-way joint 12*f* are similar to that of the first three-way joint 12*a*. Furthermore, the basic configuration of each three-way joint to be described in the later-described embodiments is also similar to that of the first three-way joint 12*a*.

In these three-way joints, when one of the three inflow-outlets is used as an inflow port and the remaining two are used as outflow ports, the three-way joints branch the flow of the refrigerant. When two of the three inflow-outlets are used as inflow ports and the remaining one is used as an outflow port, the three-way joints merge the flows of the refrigerant. The first three-way joint 12*a* is a branch part that branches the flow a discharged refrigerant discharged from the compressor 11.

The inlet side of a refrigerant passage of a water-refrigerant heat exchanger 13 is connected to one of the outflow ports of the first three-way joint 12*a*. One of the inflow port sides of the sixth three-way joint 12*f* is connected to the other of the outflow ports of the first three-way joint 12*a*. A refrigerant passage from the other of the outflow ports of the first three-way joint 12*a* to the one of the inflow ports of the sixth three-way joint 12*f* is a bypass passage 21*a*. A bypass side flow rate adjustment valve 14*d* is disposed in the bypass passage 21*a*.

The bypass side flow rate adjustment valve 14*d* is a decompression unit on the bypass passage side that, in a hot gas heating mode or the like to be described later, decompresses a discharged refrigerant flowing out of the other of the outflow ports of the first three-way joint 12*a* (i.e., the other of the discharged refrigerants branched at the first three-way joint 12*a*). The bypass side flow rate adjustment valve 14*d* is a bypass flow rate adjustment unit that adjusts the flow rate (mass flow rate) of the refrigerant flowing through the bypass passage 21*a*.

The bypass side flow rate adjustment valve 14*d* is an electric variable aperture mechanism including a valve body that changes a throttle opening degree (i.e., a throttle opening degree) and an electric actuator (specifically, a stepping motor) that displaces the valve body. Operation of the bypass side flow rate adjustment valve 14*d* is controlled by a control pulse output from the control device 60.

The bypass side flow rate adjustment valve 14*d* has a full-open function that functions as a simple refrigerant passage by fully opening the valve opening degree, with rarely exhibiting a refrigerant decompression effect and a flow rate adjustment effect. The bypass side flow rate adjustment valve 14*d* has a full-close function that closes the refrigerant passage by fully closing the valve opening degree.

As described later, the heat pump cycle 10 further includes a heating expansion valve 14*a*, an air conditioning expansion valve 14*b*, and a cooling expansion valve 14*c*.

The basic configurations of the heating expansion valve 14*a*, the air conditioning expansion valve 14*b*, and the cooling expansion valve 14*c* are similar to that of the bypass side flow rate adjustment valve 14*d*. Furthermore, the basic configurations of each expansion valve and each flow rate adjustment valve described in the later-described embodiments are similar to that of the bypass side flow rate adjustment valve 14*d*.

The heating expansion valve 14*a*, the air conditioning expansion valve 14*b*, the cooling expansion valve 14*c*, and the bypass side flow rate adjustment valve 14*d* can switch the refrigerant circuit by exhibiting the above full-close function. Accordingly, the heating expansion valve 14*a*, the air conditioning expansion valve 14*b*, the cooling expansion valve 14*c*, and the bypass side flow rate adjustment valve 14*d* also function as a refrigerant circuit switching part.

Of course, the heating expansion valve 14*a*, the air conditioning expansion valve 14*b*, the cooling expansion valve 14*c*, and the bypass side flow rate adjustment valve 14*d* may be formed by combining a variable aperture mechanism that does not have a full-close function and an on-off valve that opens and closes an aperture passage. In this case, each on-off valve serves as the refrigerant circuit switching part.

The water-refrigerant heat exchanger 13 is a heat exchange unit that exchanges heat between the discharged refrigerant flowing out of the one of the outflow ports of the first three-way joint 12*a* (i.e., one of the discharged refrigerants branched at the first three-way joint 12*a*) and the high-temperature side heat medium circulating in the high-temperature side heat medium circuit 30. The water-refrigerant heat exchanger 13 dissipates the heat of the discharged refrigerant to the high-temperature side heat medium to heat the high-temperature side heat medium.

An inflow port side of the second three-way joint 12*b* is connected to the outlet of the refrigerant passage of the water-refrigerant heat exchanger 13. The inlet side of the heating expansion valve 14*a* is connected to one of the outflow ports of the second three-way joint 12*b*. One of the inflow port sides of a four-way joint 12*x* is connected to the other of the outflow ports of the second three-way joint 12*b*. A refrigerant passage from the other of the outflow ports of the second three-way joint 12*b* to the one of the inflow ports of the four-way joint 12*x* is a dehumidification passage 21*b*.

A dehumidification on-off valve 22*a* is disposed in the dehumidification passage 21*b*. The dehumidification on-off valve 22*a* is an on-off valve that opens and closes the dehumidification passage 21*b*. The dehumidification on-off valve 22*a* is an electromagnetic valve whose opening/closing operation is controlled by a control voltage output from the control device 60. The dehumidification on-off valve 22*a* can switch the refrigerant circuit by opening and closing the dehumidification passage 21*b*. Accordingly, the dehumidification on-off valve 22*a* is the refrigerant circuit switching part.

The four-way joint 12*x* is a joint part having four inflow-outlets communicating with each other. As the four-way joint 12*x*, a joint part formed similarly to the above three-way joint can be adopted. As the four-way joint 12*x*, one formed by combining two three-way joints may be adopted.

The heating expansion valve 14*a* is a decompression unit on an outdoor heat exchanger side that decompresses the refrigerant to flow into an outdoor heat exchanger 15 in a heating mode or the like to be described later. Furthermore, the heating expansion valve 14*a* is a flow rate adjustment part on the outdoor heat exchanger side that adjusts a flow rate (mass flow rate) of the refrigerant to flow into the outdoor heat exchanger 15.

The refrigerant inlet side of the outdoor heat exchanger 15 is connected to the outlet of the heating expansion valve 14*a*. The outdoor heat exchanger 15 is an outdoor heat exchange unit that exchanges heat between the refrigerant flowing out of the heating expansion valve 14*a* and the outside air blown by a non-shown outside air fan. The outdoor heat exchanger 15 is disposed on the front side of the driving device room. Therefore, when the vehicle is traveling, the traveling air having flowed into the driving device room through a grill can be applied to the outdoor heat exchanger 15.

The inlet side of the third three-way joint 12*c* (e.g., third three-way valve) is connected to the refrigerant outlet of the outdoor heat exchanger 15. Another of the inflow port sides of the four-way joint 12*x* is connected to one of the outflow ports of the third three-way joint 12*c* via a first check valve 16*a*. One of the inflow ports of a four three-way joint 12*d* is connected to the other of the outflow ports of the third three-way joint 12*c*. A refrigerant passage from the other of the outflow ports of the third three-way joint 12*c* to the one of the inflow ports of the four three-way joint 12*d* is a heating passage 21*c*.

A heating on-off valve 22*b* is disposed in the heating passage 21*c*. The heating on-off valve 22*b* is an on-off valve that opens and closes the heating passage 21*c*. The basic configuration of the heating on-off valve 22*b* is similar to that of the dehumidification on-off valve 22*a*. Accordingly, the heating on-off valve 22*b* is the refrigerant circuit switching part. Furthermore, the basic configuration of each on-off valve to be described in the later-described embodiments is also similar to that of the dehumidification on-off valve 22*a*.

The first check valve 16*a* allows the refrigerant to flow from the third three-way joint 12*c* side to the four-way joint 12*x* side, and prohibits the refrigerant from flowing from the four-way joint 12*x* side to the third three-way joint 12*c* side.

The refrigerant inlet side of an indoor evaporator 18 is connected to one of the outflow ports of the four-way joint 12*x* via the air conditioning expansion valve 14*b*. The air conditioning expansion valve 14*b* is a decompression unit on an indoor evaporator side that decompresses the refrigerant flowing out of the one of the outflow ports of the four-way joint 12*x* in an air conditioning mode or the like to be described later. Furthermore, the air conditioning expansion valve 14*b* is a flow rate adjustment part on the indoor evaporator side that adjusts the flow rate (mass flow rate) of the refrigerant to flow into the indoor evaporator 18.

The indoor evaporator 18 is disposed in an air conditioning case 51 for the indoor air conditioning unit 50 to be described later. The indoor evaporator 18 is an air conditioning evaporation part that exchanges heat between the low-pressure refrigerant decompressed by the air conditioning expansion valve 14*b* and the ventilation air having been blown from an indoor blower 52 toward the vehicle interior. The indoor evaporator 18 causes the low-pressure refrigerant to evaporate to exert an endothermic effect, whereby the ventilation air is cooled.

One of the inflow port sides of the fifth three-way joint 12*e* is connected to the refrigerant outlet of the indoor evaporator 18 via an evaporation pressure adjustment valve 19 and a second check valve 16*b*.

The evaporation pressure adjustment valve 19 is a variable aperture mechanism that maintains a refrigerant evaporation temperature in the indoor evaporator 18 at a temperature equal to or higher than a temperature (in the present embodiment, one degree) at which frost formation in the indoor evaporator 18 can be suppressed. The evaporation pressure adjustment valve 19 includes a mechanical mechanism that increases a valve opening degree as the pressure of the refrigerant on the refrigerant outlet side of the indoor evaporator 18 rises.

The second check valve 16*b* allows the refrigerant to flow from the outlet side of the evaporation pressure adjustment valve 19 to the fifth three-way joint 12*e* side, and prohibits the refrigerant from flowing from the fifth three-way joint 12*e* side to the evaporation pressure adjustment valve 19 side.

The other of the inflow port sides of the sixth three-way joint 12*f* is connected to another of the outflow ports of the four-way joint 12*x* via the cooling expansion valve 14*c*. The inlet side of a refrigerant passage of a chiller 20 is connected to the outflow port of the sixth three-way joint 12*f*.

The cooling expansion valve 14*c* is a decompression unit on the chiller side that decompresses the refrigerant to flow into the chiller 20 in a cooling air-conditioning mode, a hot gas heating mode, or the like to be described later. Furthermore, the cooling expansion valve 14*c* is a flow rate adjustment part on the chiller side that adjusts the flow rate (mass flow rate) of the refrigerant to flow into the chiller 20.

The chiller 20 is a cooling evaporation part that exchanges heat between the low-pressure refrigerant decompressed by the cooling expansion valve 14*c* and the low-temperature side heat medium circulating in the low-temperature side heat medium circuit 40 to evaporate the low-pressure refrigerant. The chiller 20 causes the low-pressure refrigerant to evaporate to exert an endothermic effect, whereby the low-temperature side heat medium is cooled.

The other of the inflow port sides of a fourth three-way joint 12*d* (e.g., fourth three-way valve) is connected to the outlet of the refrigerant passage of the chiller 20. The other of the inflow port sides of the fifth three-way joint 12*e* is connected to the outflow port of the fourth three-way joint 12*d*.

The inlet side of an accumulator 23 is connected to the outflow port of the fifth three-way joint 12*e*. The accumulator 23 is a low-pressure side gas-liquid separator that separates the refrigerant having flowed thereinto into gas and liquid and stores a surplus liquid-phase refrigerant in the cycle. The gas-phase refrigerant outlet of the accumulator 23 is connected to the suction port side of the compressor 11.

Next, the high-temperature side heat medium circuit 30 will be described. The high-temperature side heat medium circuit 30 is a heat medium circulation circuit that circulates the high-temperature side heat medium. In the present embodiment, an ethylene glycol aqueous solution is adopted as the high-temperature side heat medium. In the high-temperature side heat medium circuit 30, a heat medium passage of the water-refrigerant heat exchanger 13, a high-temperature side pump 31, a heater core 32, and the like are disposed.

The high-temperature side pump 31 is a high-temperature side heat medium pumping part that pumps the high-temperature side heat medium flowing out of the heat medium passage of the water-refrigerant heat exchanger 13 to the heat medium inlet side of the heater core 32. The high-temperature side pump 31 is an electric pump whose rotation speed (i.e., pumping capability) is controlled by a control voltage output from the control device 60.

The heater core 32 is a heating heat exchanger that exchanges heat between the high-temperature side heat medium heated by the water-refrigerant heat exchanger 13 and the ventilation air having passed through the indoor evaporator 18 in order to heat the ventilation air. The heater core 32 is disposed in the air conditioning case 51 for the indoor air conditioning unit 50. The inlet side of the heat medium passage of the water-refrigerant heat exchanger 13 is connected to the heat medium outlet of the heater core 32.

Accordingly, each of components that are the water-refrigerant heat exchanger 13 and the high-temperature side heat medium circuit 30 of the present embodiment is a heating unit that heat the ventilation air, which is a heating object, using the one of the discharged refrigerants branched at the first three-way joint 12*a* as a heat source.

Next, the low-temperature side heat medium circuit 40 will be described. The low-temperature side heat medium circuit 40 is a heat medium circuit that circulates the low-temperature side heat medium. In the present embodiment, the same kind of fluid as the high-temperature side heat medium is adopted as the low-temperature side heat medium. A low-temperature side pump 41, a cooling water passage 70*a* of the battery 70, a heat medium passage of the chiller 20, and the like are connected to the low-temperature side heat medium circuit 40.

The low-temperature side pump 41 is a low-temperature side heat medium pumping part that pumps the low-temperature side heat medium flowing out of the cooling water passage 70*a* of the battery 70 to the inlet side of the heat medium passage of the chiller 20. The basic configuration of the low-temperature side pump 41 is similar to that of the high-temperature side pump 31. The inlet side of the cooling water passage 70*a* of the battery 70 is connected to the outlet side of the heat medium passage of the chiller 20.

The cooling water passage 70*a* of the battery 70 is a cooling water passage formed to cool the battery 70 by causing the low-temperature side heat medium cooled by the chiller 20 to flow through. The cooling water passage 70*a* is formed in a battery dedicated case that houses the plurality of stacked battery cells.

The passage configuration of the cooling water passage 70*a* is a passage configuration in which a plurality of passages are connected in parallel in the battery dedicated case. As a result, all the battery cells can be cooled evenly in the cooling water passage 70*a*. The suction port side of the low-temperature side pump 41 is connected to the outlet of the cooling water passage 70*a*.

Next, the indoor air conditioning unit 50 will be described. The indoor air conditioning unit 50 is a unit in which a plurality of components are integrated in order to blow out the ventilation air, the temperature of which has been adjusted to an appropriate temperature for air conditioning the vehicle interior, to an appropriate location in the vehicle interior. The indoor air conditioning unit 50 is disposed inside an instrument panel in the foremost part of the vehicle interior.

The indoor air conditioning unit 50 is formed by housing the indoor blower 52, the indoor evaporator 18, the heater core 32, and the like in the air conditioning case 51 that forms an air passage for the ventilation air. The air conditioning case 51 is made of a resin (e.g., polypropylene) with a certain degree of elasticity and excellent strength.

An inside/outside air switching device 53 is disposed on the most upstream side, in a ventilation air flow, of the air conditioning case 51. The inside/outside air switching device 53 introduces, in a switching manner, inside air (i.e., vehicle interior air) and outside air (i.e., vehicle exterior air) into the air conditioning case 51. Operation of the inside/outside air switching device 53 is controlled by a control signal output from the control device 60.

The indoor blower 52 is disposed on the downstream side, in the ventilation air flow, of the inside/outside air switching device 53. The indoor blower 52 is an air blowing part that blows the air sucked via the inside/outside air switching device 53 toward the vehicle interior. The rotation speed (i.e., air blowing capability) of the indoor blower 52 is controlled by a control voltage output from the control device 60.

The indoor evaporator 18 and the heater core 32 are disposed on the downstream side, in the ventilation air flow, of the indoor blower 52. The indoor evaporator 18 is disposed on the upstream side, in the ventilation air flow, of the heater core 32. In the air conditioning case 51, a cold air bypass passage 55, that causes the ventilation air having passed through the indoor evaporator 18 to flow through by bypassing the heater core 32, is formed.

An air mix door 54 is disposed on the downstream side, in the ventilation air flow, of the indoor evaporator 18 in the air conditioning case 51 and on the upstream side, in the ventilation air flow, of the heater core 32 and the cold air bypass passage 55.

The air mix door 54 adjusts an air volume ratio between, of the ventilation air having passed through the indoor evaporator 18, an air volume of the ventilation air to be caused to pass through the heater core 32 side and an air volume of the ventilation air to be caused to pass through the cold air bypass passage 55. Operation of an actuator for driving the air mix door 54 is controlled by a control signal output from the control device 60.

A mixing space 56 is disposed on the downstream side, in the ventilation air flow, of the heater core 32 and the cold air bypass passage 55. The mixing space 56 is a space for mixing the ventilation air heated by the heater core 32 and the ventilation air that has passed through the cold air bypass passage 55 and is not heated.

Accordingly, in the indoor air conditioning unit 50, the temperature of the ventilation air (i.e., conditioned air), that is mixed in the mixing space 56 and blown out into the vehicle interior, can be adjusted by adjusting the opening degree of the air mix door 54. The air mix door 54 of the present embodiment is a flow rate adjustment part that adjusts the flow rate of the ventilation air whose heat is exchanged at the heater core 32.

A plurality of non-shown opening holes for blowing out the conditioned air toward various locations in the vehicle interior are formed in the most downstream portion, in the ventilation air flow, of the air conditioning case 51. In the plurality of opening holes, a non-shown blowout mode door, that opens and closes each opening hole, is disposed. Operation of an actuator for driving the blowout mode door is controlled by a control signal output from the control device 60.

Accordingly, in the indoor air conditioning unit 50, the conditioned air adjusted to an appropriate temperature can be blown out to an appropriate location in the vehicle interior by switching the opening hole the blowout mode door opens and closes.

Next, an electric control part of the present embodiment will be described. The control device 60 includes a known microcomputer including a CPU, a ROM, a RAM, and the like, and peripheral circuits thereof. The control device 60 performs various calculations and processes on the basis of a control program stored in the ROM. Based on the results of the calculations and processes, the control device 60 controls the operations of the various control target equipment 11, 14*a* to 14*d*, 22*a*, 22*b*, 31, 41, 52, 53, and the like connected to the output side.

Figure 2:
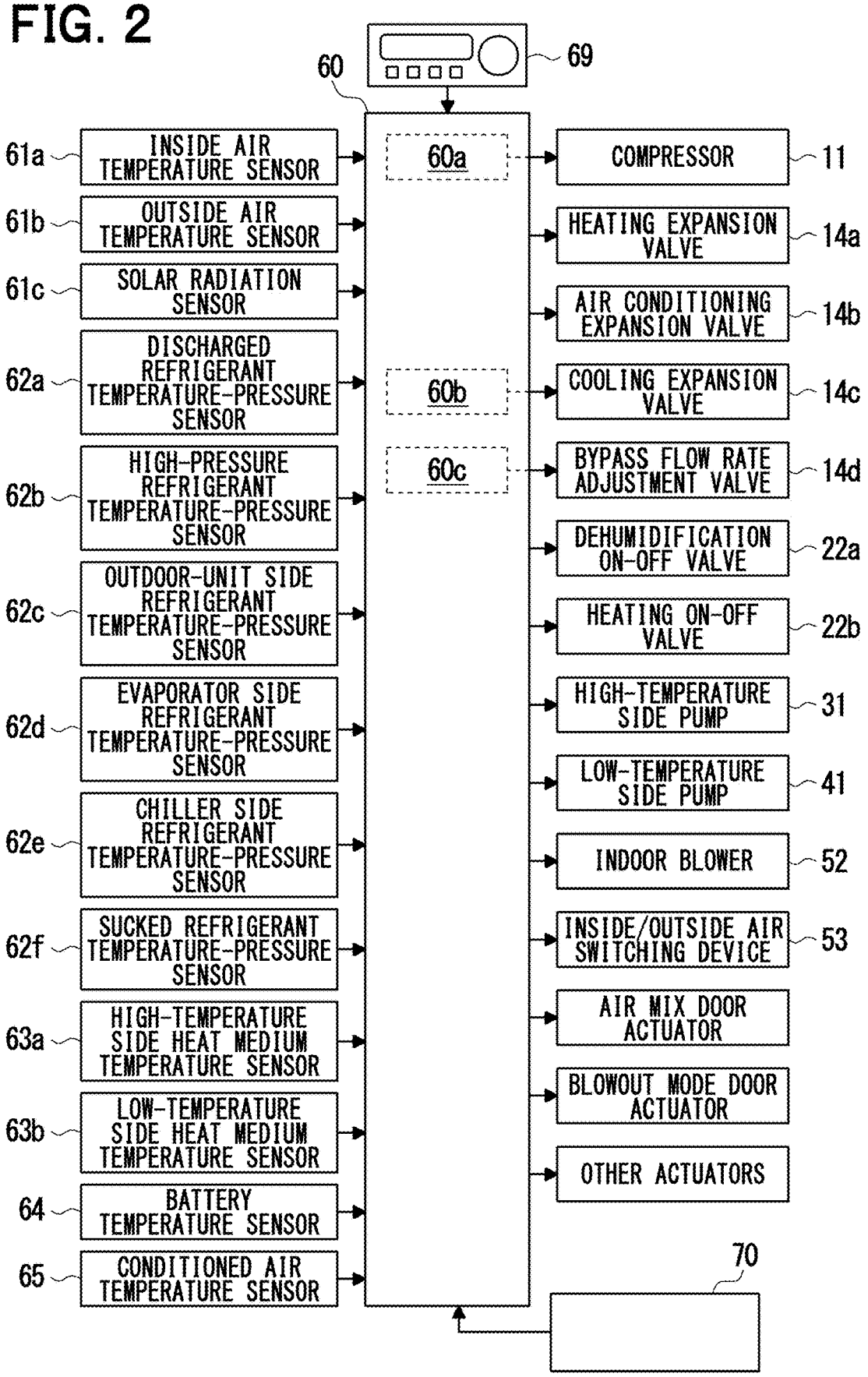
FIG. 2 is a block diagram showing an electric control part of the vehicle air conditioner according to the first embodiment.

To the input side of the control device 60, a group of control sensors, such as an inside air temperature sensor 61*a*, an outside air temperature sensor 61*b*, a solar radiation sensor 61*c*, a discharged refrigerant temperature pressure sensor 62*a*, a high-pressure side refrigerant temperature pressure sensor 62*b*, an outdoor unit side refrigerant temperature pressure sensor 62*c*, an evaporator side refrigerant temperature pressure sensor 62*d*, a chiller side refrigerant temperature pressure sensor 62*e*, a sucked refrigerant temperature pressure sensor 62*f*, a high-temperature side heat medium temperature sensor 63*a*, a low-temperature side heat medium temperature sensor 63*b*, a battery temperature sensor 64, and a conditioned air temperature sensor 65, are connected as shown in the block diagram of FIG. 2.

The inside air temperature sensor 61*a* is an inside air temperature detection part that detects a vehicle interior temperature (inside air temperature) Tr. The outside air temperature sensor 61*b* is an outside air temperature detection part that detects a vehicle exterior temperature (outside air temperature) Tam. The solar radiation sensor 61*c* is a solar radiation amount detection part that detects a solar radiation amount As with which the vehicle interior is irradiated.

The discharged refrigerant temperature pressure sensor 62*a* is a discharged refrigerant temperature pressure detection part that detects a discharged refrigerant temperature Td and a discharged refrigerant pressure Pd of the discharged refrigerant discharged from the compressor 11.

The high-pressure side refrigerant temperature pressure sensor 62*b* is a high-pressure side refrigerant temperature pressure detection part that detects a high-pressure side refrigerant temperature T1 and a high-pressure side refrigerant pressure P1 of the refrigerant flowing out of the water-refrigerant heat exchanger 13.

The outdoor unit side refrigerant temperature pressure sensor 62*c* is an outdoor unit side refrigerant temperature pressure detection part that detects an outdoor unit side refrigerant temperature T2 and an outdoor unit side refrigerant pressure P2 of the refrigerant flowing out of the outdoor heat exchanger 15.

The evaporator side refrigerant temperature pressure sensor 62*d* is an evaporator side refrigerant temperature pressure detection part that detects an evaporator side refrigerant temperature Te and an evaporator side refrigerant pressure Pe of the refrigerant flowing out of the indoor evaporator 18.

The chiller side refrigerant temperature pressure sensor 62*e* is a chiller side refrigerant temperature pressure detection part that detects a chiller side refrigerant temperature Tc and a chiller side refrigerant pressure Pc of the refrigerant flowing out of the refrigerant passage of the chiller 20.

The sucked refrigerant temperature pressure sensor 62*f* is a sucked refrigerant temperature pressure detection part that detects a sucked refrigerant temperature Ts and a sucked refrigerant pressure Ps of the sucked refrigerant to be sucked into the compressor 11.

In the present embodiment, as the refrigerant temperature pressure sensors, detection parts in which a pressure detection part and a temperature detection part are integrated are adopted, but of course, pressure detection parts and temperature detection parts that are configured separately may be adopted.

The high-temperature side heat medium temperature sensor 63*a* is a high-temperature side heat medium temperature detection part that detects a high-temperature side heat medium temperature TWH, the temperature of the high-temperature side heat medium flowing into the heater core 32.

The low-temperature side heat medium temperature sensor 63*b* is a low-temperature side heat medium temperature detection part that detects a low-temperature side heat medium temperature TWL, the temperature of the low-temperature side heat medium flowing into the cooling water passage 70*a* of the battery 70.

The battery temperature sensor 64 is a battery temperature detection part that detects a battery temperature TB, the temperature of the battery 70. The battery temperature sensor 64 includes a plurality of temperature sensors, and detects temperatures at a plurality of locations of the battery 70. Therefore, the control device 60 can detect temperature differences and temperature distributions among the respective battery cells forming the battery 70. Furthermore, as the battery temperature TB, an average value of the detection values of the plurality of temperature sensors is adopted.

The conditioned air temperature sensor 65 is a conditioned air temperature detection part that detects a ventilation air temperature TAV of the ventilation air to be blown from the mixing space 56 into the vehicle interior. The ventilation air temperature TAV is an object temperature of the ventilation air as the heating object.

Furthermore, an operation panel 69 disposed near the instrument panel in the front part of the vehicle interior is connected to the input side of the control device 60, as shown in FIG. 2. Operation signals from various operation switches provided on the operation panel 69 are input to the control device 60.

Specific examples of the various operation switches provided on the operation panel 69 include an auto switch, an air conditioner switch, an air volume setting switch, and a temperature setting switch.

The auto switch is an automatic control setting part that sets or cancels the automatic control operation of the vehicle air conditioner 1. The air conditioner switch is a cooling request part that requests the indoor evaporator 18 to cool the ventilation air. The air volume setting switch is an air volume setting part that manually sets the air blowing volume of the indoor blower 52. The temperature setting switch is a temperature setting part that sets a set temperature Tset of the vehicle interior.

Note that the control device 60 of the present embodiment is a device in which control parts that control the various control target equipment connected to the output side thereof are integrated. Accordingly, a configuration (hardware and software) for controlling the operation of each control target equipment constitutes the control part that controls the operation of each control target equipment.

For example, of the control device 60, a configuration for controlling the rotation speed of the compressor 11 constitutes a discharge capability control part 60*a*. A configuration for controlling the operation of a heating-unit side decompression unit (in the present embodiment, the cooling expansion valve 14*c*) constitutes a heating unit side control part 60*b*. A configuration for controlling the operation of the bypass side flow rate adjustment valve 14*d* constitutes a bypass side control part 60*c*.

Next, the operation of the vehicle air conditioner 1 of the present embodiment having the above configuration will be described. In the vehicle air conditioner 1 of the present embodiment, various operation modes are switched in order to perform air conditioning of the vehicle interior and temperature adjustment for the battery 70. Switching between the operation modes is performed by executing a control program stored in advance in the control device 60.

The control program is executed not only when a so-called IG switch is brought into an input state (ON) and the vehicle system is being activated, but also such as when the battery 70 is being charged from an external power supply. A main routine of the control program will be described with reference to the flowchart of FIG. 3. Respective control steps described in the flowchart of FIG. 3 and the like are various function implementation parts the control device 60 includes.

Figure 3:
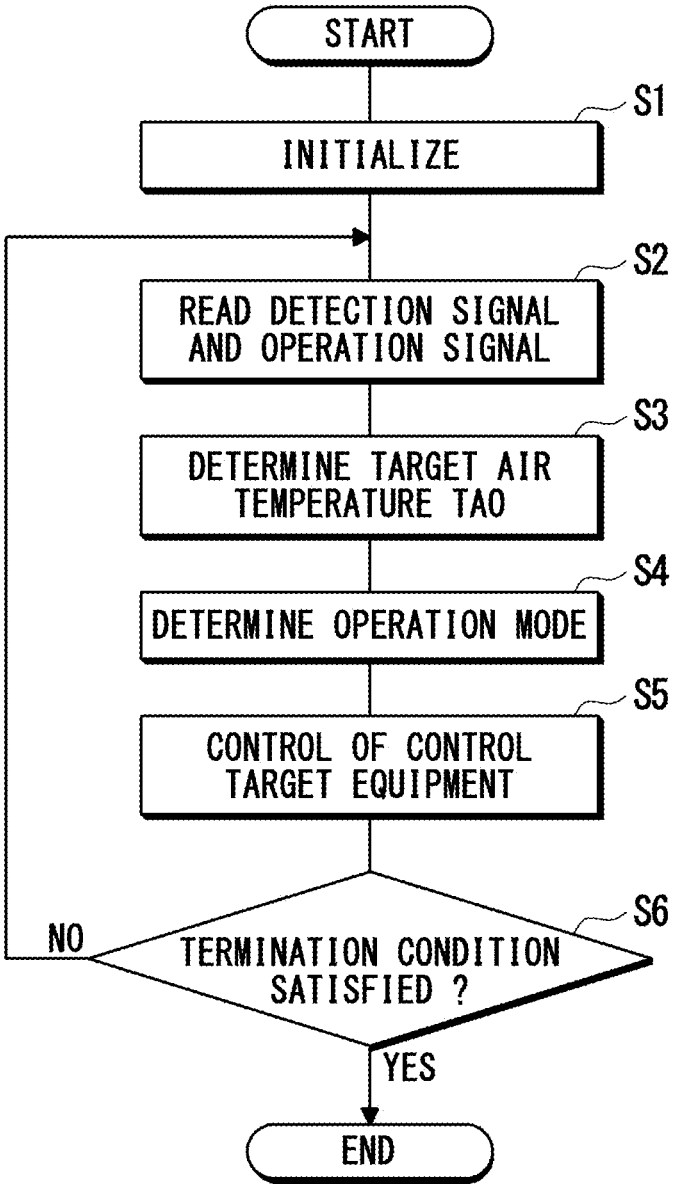
FIG. 3 is a flowchart of a main routine of a control program according to the first embodiment.

First, in a step S1 in FIG. 3, initialization of a flag, a timer, and the like, and initialization of initial alignment of an electric actuator and the like, are performed. Next, in a step S2, detection signals from the group of control sensors and operation signals from the operation panel 69 are read. Next, in a step S3, a target air temperature TAO is determined. The target air temperature TAO is a target temperature of the ventilation air to be blown out into the vehicle interior. Accordingly, the step S3 is a target temperature determination part.

In the step S3, the target air temperature TAO is specially determined by using the following mathematical expression F1:

$$TAO = Kset \times Tset - Kr \times Tr - Kam \times Tam - Ks \times As + C \quad \text{(F1)}$$

Where, Tset is a vehicle interior target temperature set by the temperature setting switch. Tr is an inside air temperature detected by the inside air temperature sensor 61*a*. Tam is an outside air temperature detected by the outside air temperature sensor 61*b*. As is a solar radiation amount detected by the solar radiation sensor 61*c*. Kset, Kr, Kam, and Ks are control gains, and C is a correction constant.

Next, in a step S4, an operation mode is selected using the detection signals and the operation signals read in the step S2 and the target air temperature TAO determined in the step S3. Next, in a step S5, the operations of the various control target equipment are controlled such that the operation mode selected in the step S4 is executed.

Next, in a step S6, it is determined whether a predetermined termination condition of the vehicle air conditioner 1 is satisfied. When it is determined in the step S6 that the termination condition is not satisfied, the program returns to the step S2. When it is determined in the step S6 that the termination condition has been satisfied, the program is terminated.

Here, the termination condition of the present embodiment is satisfied when, in a state where the battery 70 is not being charged from the external power supply, the IG switch is brought into a non-input state (OFF). In addition, the termination condition of the present embodiment is satisfied when, in a state where the IG switch is in a non-input state (OFF), charging of the battery 70 from the external power supply terminates. Hereinafter, a detailed operation in each operation mode selected in the step S4 will be described.

(a) Air Conditioning Mode

An air conditioning mode is an operation mode for air conditioning the vehicle interior by blowing out the cooled ventilation air into the vehicle interior. In the control program of the present embodiment, the air conditioning mode is selected when the outside air temperature Tam is relatively high (in the present embodiment, 25° C. or higher) as mainly in summer.

The air conditioning mode includes a single air conditioning mode for air conditioning the vehicle interior without cooling the battery 70, and a cooling air-conditioning mode for cooling the battery 70 and air conditioning the vehicle interior. In the control program of the present embodiment, an operation mode for cooling the battery 70 is executed when the battery temperature TB becomes equal to or higher than a reference upper limit temperature KTBH determined in advance.

(a-1) Single Air Conditioning Mode

In the heat pump cycle 10 in the single air conditioning mode, the control device 60 brings the heating expansion valve 14*a* into a fully opened state, brings the air conditioning expansion valve 14*b* into an aperture state that exerts a refrigerant decompression effect, brings the cooling expansion valve 14*c* into a fully closed state, and brings the bypass side flow rate adjustment valve 14*d* into a fully closed state. In addition, the control device 60 closes the dehumidification on-off valve 22*a* and closes the heating on-off valve 22*b*.

As a result, in the heat pump cycle 10 in the single air conditioning mode, a refrigerant circuit is switched to in which the refrigerant discharged from the compressor 11 circulates through the water-refrigerant heat exchanger 13, the heating expansion valve 14*a* in the fully opened state, the outdoor heat exchanger 15, the air conditioning expansion valve 14*b* in the aperture state, the indoor evaporator 18, the evaporation pressure adjustment valve 19, the accumulator 23, and the suction port of the compressor 11 in this order.

In the high-temperature side heat medium circuit 30 in the single air conditioning mode, the control device 60 operates the high-temperature side pump 31 so as to exhibit predetermined reference pumping capability. Therefore, in the high-temperature side heat medium circuit 30, the high-temperature side heat medium pumped from the high-temperature side pump 31 circulates through the heater core 32, the heat medium passage of the water-refrigerant heat exchanger 13, and the suction port of the high-temperature side pump 31 in this order.

In the indoor air conditioning unit 50 in the single air conditioning mode, the control device 60 adjusts the opening degree of the air mix door 54 such that the ventilation air temperature TAV detected by the conditioned air temperature sensor 65 approaches the target air temperature TAO.

Based on the target air temperature TAO, the control device 60 determines the control voltage to be output to the indoor blower 52 with reference to a control map stored in advance in the control device 60. In the control map, the air blowing volume of the indoor blower 52 is maximized in an extremely low temperature range (maximum air conditioning range) and an extremely high temperature range (maximum heating range) of the target air temperature TAO, and the air blowing volume is made smaller as the ventilation air temperature TAV approaches an intermediate temperature range.

Based on the target air temperature TAO, the control device 60 controls the operations of the inside/outside air switching device 53 and the blowout mode door. In addition, the control device 60 appropriately controls the operations of the other control target equipment.

Accordingly, in the heat pump cycle 10 in the single air conditioning mode, a vapor compression refrigeration cycle is configured in which the water-refrigerant heat exchanger 13 and the outdoor heat exchanger 15 are caused to function as condensers that dissipate the heat of the refrigerant and condense the refrigerant, and the indoor evaporator 18 is caused to function as an evaporator that evaporates the refrigerant.

In the high-temperature side heat medium circuit 30 in the single air conditioning mode, the high-temperature side heat medium pumped from the high-temperature side pump 31 flows into the heater core 32 and exchanges heat with the ventilation air. The high-temperature side heat medium flowing out of the heater core 32 flows into the heat medium passage of the water-refrigerant heat exchanger 13 and exchanges heat with the discharged refrigerant. As a result, the high-temperature side heat medium is heated. The high-temperature side heat medium heated by the water-refrigerant heat exchanger 13 is sucked into the high-temperature side pump 31 and is pumped again to the heater core 32.

In the indoor air conditioning unit 50 in the single air conditioning mode, the ventilation air blown from the indoor blower 52 is cooled by the indoor evaporator 18. In accordance with the opening degree of the air mix door 54, the ventilation air cooled by the indoor evaporator 18 exchanges heat with the high-temperature side heat medium and is reheated in the heater core 32 such that the ventilation air temperature TAV approaches the target air temperature TAO. The ventilation air whose temperature has been adjusted is blown out into the vehicle interior, whereby air conditioning of the vehicle interior is realized.

(a-2) Cooling Air-Conditioning Mode

In the heat pump cycle 10 in the cooling air-conditioning mode, the control device 60 brings the cooling expansion valve 14*c* into an aperture state, contrary to the single air conditioning mode.

Therefore, in the heat pump cycle 10 in the cooling air-conditioning mode, the refrigerant discharged from the compressor 11 circulates similarly in the single air conditioning mode. At the same time, a refrigerant circuit is switched to in which the refrigerant discharged from the compressor 11 circulates through the water-refrigerant heat exchanger 13, the heating expansion valve 14*a* in a fully opened state, the outdoor heat exchanger 15, the cooling expansion valve 14*c* in an aperture state, the chiller 20, the accumulator 23, and the suction port of the compressor 11 in this order. That is, a refrigerant circuit is switched to in which the indoor evaporator 18 and the chiller 20 are connected in parallel for the flow of the refrigerant.

In the high-temperature side heat medium circuit 30 in the cooling air-conditioning mode, the control device 60 controls the operation of the high-temperature side pump 31 similarly in the single air conditioning mode.

In the low-temperature side heat medium circuit 40 in the cooling air-conditioning mode, the control device 60 operates the low-temperature side pump 41 so as to exhibit predetermined reference pumping capability. Therefore, in the low-temperature side heat medium circuit 40, the low-temperature side heat medium pumped from the low-temperature side pump 41 circulates through the heat medium passage of the chiller 20, the cooling water passage 70*a* of the battery 70, and the suction port of the low-temperature side pump 41 in this order.

In the indoor air conditioning unit 50 in the cooling air-conditioning mode, the control device 60 controls the air blowing capability of the indoor blower 52, the opening degree of the air mix door 54, and the operations of the inside/outside air switching device 53 and the blowout mode door, as in the single air conditioning mode. In addition, the control device 60 appropriately controls the operations of the other control target equipment.

Accordingly, in the heat pump cycle 10 in the cooling air-conditioning mode, a vapor compression refrigeration cycle is configured in which the water-refrigerant heat exchanger 13 and the outdoor heat exchanger 15 are caused to function as condensers, and the indoor evaporator 18 and the chiller 20 are caused to function as evaporators.

In the high-temperature side heat medium circuit 30 in the cooling air-conditioning mode, the high-temperature side heat medium heated by the water-refrigerant heat exchanger 13 is pumped to the heater core 32, similarly in the single air conditioning mode.

In the low-temperature side heat medium circuit 40 in the cooling air-conditioning mode, the low-temperature side heat medium pumped from the low-temperature side pump 41 flows into the chiller 20 and exchanges heat with the low-pressure refrigerant. As a result, the low-pressure refrigerant is cooled. The low-temperature side heat medium cooled by the chiller 20 flows through the cooling water passage 70*a* of the battery 70. As a result, the battery 70 is cooled. The low-temperature side heat medium flowing out of the cooling water passage 70*a* of the battery 70 is sucked into the low-temperature side pump 41 and is pumped again to the chiller 20.

In the indoor air conditioning unit 50 in the cooling air-conditioning mode, the ventilation air whose temperature has been adjusted is blown out into the vehicle interior, whereby air conditioning of the vehicle interior is realized, similarly in the single air conditioning mode.

(b) Series Dehumidification Heating Mode

A series dehumidification heating mode is an operation mode for dehumidification heating the vehicle interior by reheating the ventilation air cooled and dehumidified and blowing out the ventilation air into the vehicle interior. In the control program of the present embodiment, the series dehumidification heating mode is selected when the outside air temperature Tam becomes a temperature within a predetermined medium-to-high temperature range (in the present embodiment, 10° C. or higher and lower than 25° C.).

The series dehumidification heating mode includes a single series dehumidification heating mode for dehumidification heating the vehicle interior without cooling the battery 70, and a cooling series dehumidification heating mode for cooling the battery 70 and dehumidification heating the vehicle interior.

(b-1) Single Series Dehumidification Heating Mode

In the heat pump cycle 10 in the single series dehumidification heating mode, the control device 60 brings the heating expansion valve 14*a* into an aperture state, brings the air conditioning expansion valve 14*b* into an aperture state, brings the cooling expansion valve 14*c* into a fully closed state, and brings the bypass side flow rate adjustment valve 14*d* into a fully closed state. In addition, the control device 60 closes the dehumidification on-off valve 22*a* and closes the heating on-off valve 22*b*.

Therefore, in the heat pump cycle 10 in the single series dehumidification heating mode, a refrigerant circuit is switched to in which the refrigerant discharged from the compressor 11 circulates through the water-refrigerant heat exchanger 13, the heating expansion valve 14*a* in the aperture state, the outdoor heat exchanger 15, the air conditioning expansion valve 14*b* in the aperture state, the indoor evaporator 18, the evaporation pressure adjustment valve 19, the accumulator 23, and the suction port of the compressor 11 in this order.

In the high-temperature side heat medium circuit 30 in the single series dehumidification heating mode, the control device 60 controls the operation of the high-temperature side pump 31, similarly in the single air conditioning mode.

In the indoor air conditioning unit 50 in the single series dehumidification heating mode, the control device 60 controls the air blowing capability of the indoor blower 52, the opening degree of the air mix door 54, and the operations of the inside/outside air switching device 53 and the blowout mode door, similarly in the single air conditioning mode. In addition, the control device 60 appropriately controls the operations of the other control target equipment.

Accordingly, in the heat pump cycle 10 in the single series dehumidification heating mode, a vapor compression refrigeration cycle is configured in which the water-refrigerant heat exchanger 13 is caused to function as a condenser and the indoor evaporator 18 is caused to function as an evaporator.

In the single series dehumidification heating mode, when the saturation temperature of the refrigerant in the outdoor heat exchanger 15 is higher than the outside air temperature Tam, the outdoor heat exchanger 15 is caused to function as a condenser. When the saturation temperature of the refrigerant in the outdoor heat exchanger 15 is lower than the outside air temperature Tam, the outdoor heat exchanger 15 is caused to function as an evaporator.

In the high-temperature side heat medium circuit 30 in the single series dehumidification heating mode, the high-temperature side heat medium heated by the water-refrigerant heat exchanger 13 is pumped to the heater core 32, similarly in the single air conditioning mode.

In the indoor air conditioning unit 50 in the single series dehumidification heating mode, the ventilation air blown from the indoor blower 52 is cooled and dehumidified by the indoor evaporator 18. In accordance with the opening degree of the air mix door 54, the ventilation air cooled and dehumidified by the indoor evaporator 18 is reheated by the heater core 32 such that the ventilation air temperature TAV approaches the target air temperature TAO. The ventilation air whose temperature has been adjusted is blown out into the vehicle interior, whereby dehumidification heating of the vehicle interior is realized.

(b-2) Cooling Series Dehumidification Heating Mode

In the heat pump cycle 10 in a cooling series dehumidification heating mode, the control device 60 brings the cooling expansion valve 14*c* into an aperture state, contrary to the single series dehumidification heating mode.

Therefore, in the heat pump cycle 10 in the cooling series dehumidification heating mode, the refrigerant discharged from the compressor 11 circulates similarly in the single series dehumidification heating mode. At the same time, a refrigerant circuit is switched to in which the refrigerant discharged from the compressor 11 circulates through the water-refrigerant heat exchanger 13, the heating expansion valve 14*a* in the aperture state, the outdoor heat exchanger 15, the cooling expansion valve 14*c* in the aperture state, the chiller 20, the accumulator 23, and the suction port of the compressor 11 in this order. That is, a refrigerant circuit is switched to in which the indoor evaporator 18 and the chiller 20 are connected in parallel for the flow of the refrigerant.

In the high-temperature side heat medium circuit 30 in the cooling series dehumidification heating mode, the control device 60 controls the operation of the high-temperature side pump 31, similarly in the single air conditioning mode.

In the low-temperature side heat medium circuit 40 in the cooling series dehumidification heating mode, the control device 60 controls the operation of the low-temperature side pump 41, similarly in the cooling air-conditioning mode.

In the indoor air conditioning unit 50 in the cooling series dehumidification heating mode, the control device 60 controls the air blowing capability of the indoor blower 52, the opening degree of the air mix door 54, and the operations of the inside/outside air switching device 53 and the blowout mode door, similarly in the single air conditioning mode. In addition, the control device 60 appropriately controls the operations of the other control target equipment.

Accordingly, in the heat pump cycle 10 in the cooling series dehumidification heating mode, a vapor compression refrigeration cycle is configured in which the water-refrigerant heat exchanger 13 is caused to function as a condenser and the indoor evaporator 18 and the chiller 20 are caused to function as evaporators.

In the cooling series dehumidification heating mode, when the saturation temperature of the refrigerant in the outdoor heat exchanger 15 is higher than the outside air temperature Tam, the outdoor heat exchanger 15 is caused to function as a condenser. similarly in the single series dehumidification heating mode. When the saturation temperature of the refrigerant in the outdoor heat exchanger 15 is lower than the outside air temperature Tam, the outdoor heat exchanger 15 is caused to function as an evaporator.

In the high-temperature side heat medium circuit 30 in the cooling series dehumidification heating mode, the high-temperature side heat medium heated by the water-refrigerant heat exchanger 13 is pumped to the heater core 32, similarly in the single air conditioning mode.

In the low-temperature side heat medium circuit 40 in the cooling series dehumidification heating mode, the low-temperature side heat medium cooled by the chiller 20 flows through the cooling water passage 70*a* of the battery 70, whereby the battery 70 is cooled, similarly in the cooling air-conditioning mode.

In the indoor air conditioning unit 50 in the cooling series dehumidification heating mode, the ventilation air whose temperature has been adjusted is blown out into the vehicle interior, whereby dehumidification heating of the vehicle interior is realized, similarly in the single series dehumidification heating mode.

(c) Parallel Dehumidification Heating Mode

A parallel dehumidification heating mode is an operation mode for dehumidification heating the vehicle interior by reheating the ventilation air cooled and dehumidified, with higher heating capability than in the series dehumidification heating mode and by blowing out the ventilation air into the vehicle interior. In the control program of the present embodiment, the parallel dehumidification heating mode is selected when the outside air temperature Tam becomes a temperature within a predetermined low-to-middle temperature range (in the present embodiment, 0° C. or higher and lower than 10° C.).

The parallel dehumidification heating mode includes a single parallel dehumidification heating mode for dehumidification heating the vehicle interior without cooling the battery 70, and a cooling parallel dehumidification heating mode for cooling the battery 70 and dehumidification heating the vehicle interior.

(c-1) Single Parallel Dehumidification Heating Mode

In the heat pump cycle 10 in the single parallel dehumidification heating mode, the control device 60 brings the heating expansion valve 14*a* into an aperture state, brings the air conditioning expansion valve 14*b* into an aperture state, brings the cooling expansion valve 14*c* into a fully closed state, and brings the bypass side flow rate adjustment valve 14*d* into a fully closed state. In addition, the control device 60 opens the dehumidification on-off valve 22*a* and opens the heating on-off valve 22*b*.

Therefore, in the heat pump cycle 10 in the single parallel dehumidification heating mode, the refrigerant discharged from the compressor 11 circulates through the water-refrigerant heat exchanger 13, the heating expansion valve 14*a* in the aperture state, the outdoor heat exchanger 15, the heating passage 21*c*, the accumulator 23, and the suction port of the compressor 11 in this order. At the same time, a refrigerant circuit is switched to in which the refrigerant discharged from the compressor 11 circulates through the water-refrigerant heat exchanger 13, the dehumidification passage 21*b*, the air conditioning expansion valve 14*b* in the aperture state, the indoor evaporator 18, the evaporation pressure adjustment valve 19, the accumulator 23, and the suction port of the compressor 11 in this order. That is, a refrigerant circuit is switched to in which the outdoor heat exchanger 15 and the indoor evaporator 18 are connected in parallel for the flow of the refrigerant.

In the high-temperature side heat medium circuit 30 in the single parallel dehumidification heating mode, the control device 60 controls the operation of the high-temperature side pump 31, similarly in the single air conditioning mode.

In the indoor air conditioning unit 50 in the single parallel dehumidification heating mode, the control device 60 controls the air blowing capability of the indoor blower 52, the opening degree of the air mix door 54, and the operations of the inside/outside air switching device 53 and the blowout mode door, similarly in the single air conditioning mode. In addition, the control device 60 appropriately controls the operations of the other control target equipment.

Accordingly, in the heat pump cycle 10 in the single parallel dehumidification heating mode, a vapor compression refrigeration cycle is configured in which the water-refrigerant heat exchanger 13 is caused to function as a condenser and the outdoor heat exchanger 15 and the indoor evaporator 18 are caused to function as evaporators.

In the high-temperature side heat medium circuit 30 in the single parallel dehumidification heating mode, the high-temperature side heat medium heated by the water-refrigerant heat exchanger 13 is pumped to the heater core 32, similarly in the single air conditioning mode.

In the indoor air conditioning unit 50 in the single parallel dehumidification heating mode, the ventilation air blown from the indoor blower 52 is cooled and dehumidified by the indoor evaporator 18. In accordance with the opening degree of the air mix door 54, the ventilation air cooled and dehumidified by the indoor evaporator 18 is reheated by the heater core 32 such that the ventilation air temperature TAV approaches the target air temperature TAO. The ventilation air whose temperature has been adjusted is blown out into the vehicle interior, whereby dehumidification heating of the vehicle interior is realized.

Furthermore, in the heat pump cycle 10 in the single parallel dehumidification heating mode, the throttle opening degree of the heating expansion valve 14*a* can be made smaller than the throttle opening degree of the air conditioning expansion valve 14*b*. As a result, the refrigerant evaporation temperature in the outdoor heat exchanger 15 can be lowered to a temperature lower than the refrigerant evaporation temperature in the indoor evaporator 18.

Accordingly, in the single parallel dehumidification heating mode, the amount of heat absorbed from the outside air by the refrigerant in the outdoor heat exchanger 15 can be made larger than in the single series dehumidification heating mode, and the amount of heat dissipated from the refrigerant to the high-temperature side heat medium in the water-refrigerant heat exchanger 13 can be made large. As a result, in the single parallel dehumidification heating mode, the heating capability for the ventilation air in the heater core 32 can be improved more than in the single series dehumidification heating mode.

(c-2) Cooling Parallel Dehumidification Heating Mode

In the heat pump cycle 10 in the cooling parallel dehumidification heating mode, the control device 60 brings the cooling expansion valve 14*c* into an aperture state, contrary to the single parallel dehumidification heating mode.

Therefore, in the heat pump cycle 10 in the cooling parallel dehumidification heating mode, the refrigerant discharged from the compressor 11 circulates similarly in the single parallel dehumidification heating mode. At the same time, a refrigerant circuit is switched to in which the refrigerant discharged from the compressor 11 circulates through the water-refrigerant heat exchanger 13, the dehumidification passage 21*b*, the cooling expansion valve 14*c* in the aperture state, the chiller 20, the accumulator 23, and the suction port of the compressor 11 in this order. That is, a refrigerant circuit is switched to in which the outdoor heat exchanger 15, the indoor evaporator 18, and the chiller 20 are connected in parallel for the flow of the refrigerant.

In the high-temperature side heat medium circuit 30 in the cooling parallel dehumidification heating mode, the control device 60 controls the operation of the high-temperature side pump 31, similarly in the single air conditioning mode.

In the low-temperature side heat medium circuit 40 in the cooling parallel dehumidification heating mode, the control device 60 controls the operation of the low-temperature side pump 41, similarly in the cooling air-conditioning mode.

In the indoor air conditioning unit 50 in the cooling parallel dehumidification heating mode, the control device 60 controls the air blowing capability of the indoor blower 52, the opening degree of the air mix door 54, and the operations of the inside/outside air switching device 53 and the blowout mode door, similarly in the single air conditioning mode. In addition, the control device 60 appropriately controls the operations of the other control target equipment.

Accordingly, in the heat pump cycle 10 in the cooling parallel dehumidification heating mode, a vapor compression refrigeration cycle is configured in which the water-refrigerant heat exchanger 13 is caused to function as a condenser and the outdoor heat exchanger 15, the indoor evaporator 18, and the chiller 20 are caused to function as evaporators.

In the high-temperature side heat medium circuit 30 in the cooling parallel dehumidification heating mode, the high-temperature side heat medium heated by the water-refrigerant heat exchanger 13 is pumped to the heater core 32, similarly in the single air conditioning mode.

In the low-temperature side heat medium circuit 40 in the cooling parallel dehumidification heating mode, the low-temperature side heat medium cooled by the chiller 20 flows through the cooling water passage 70*a* of the battery 70, whereby the battery 70 is cooled, similarly in the cooling air-conditioning mode.

In the indoor air conditioning unit 50 in the cooling parallel dehumidification heating mode, the ventilation air whose temperature has been adjusted is blown out into the vehicle interior, whereby dehumidification heating of the vehicle interior is realized, similarly in the single parallel dehumidification heating mode.

(d) Parallel Hot Gas Dehumidification Heating Mode

A parallel hot gas dehumidification heating mode is an operation mode that is executed in order to suppress a decrease in the heating capability for the ventilation air when it is determined that frost has been formed in the outdoor heat exchanger 15 during the execution of the parallel dehumidification heating mode. In the control program of the present embodiment, it is determined that, when a predetermined frost formation condition is satisfied, frost has been formed in the outdoor heat exchanger 15.

The frost formation condition of the present embodiment is satisfied when a time, at which the outdoor unit side refrigerant temperature T2 detected by the outdoor unit side refrigerant temperature pressure sensor 62*c* is equal to or lower than a reference frost formation temperature KTDF (in the present embodiment, −5° C.), is equal to or longer than a reference frost formation time KTmDF (in the present embodiment, 5 minutes).

The parallel hot gas dehumidification heating mode includes a single parallel hot gas dehumidification heating mode and a cooling parallel hot gas dehumidification heating mode. The single parallel hot gas dehumidification heating mode is executed when the frost formation condition is satisfied during the execution of the single parallel dehumidification heating mode. The cooling parallel hot gas dehumidification heating mode is executed when the frost formation condition is satisfied during the execution of the cooling parallel dehumidification heating mode.

(d-1) Single Parallel Hot Gas Dehumidification Heating Mode

In the heat pump cycle 10 in the single parallel hot gas dehumidification heating mode, the control device 60 brings the bypass side flow rate adjustment valve 14*d* into an aperture state and brings the cooling expansion valve 14*c* into an aperture state, contrary to the single parallel dehumidification heating mode.

Therefore, in the heat pump cycle 10 in the single parallel hot gas dehumidification heating mode, the refrigerant discharged from the compressor 11 circulates similarly in the cooling parallel dehumidification heating mode. At the same time, a refrigerant circuit is switched to in which a part of the refrigerant discharged from the compressor 11 circulates through the bypass side flow rate adjustment valve 14*d* in the aperture state, the chiller 20, the accumulator 23, and the suction port of the compressor 11 in this order.

Furthermore, the control device 60 appropriately controls the operations of the other control target equipment. For example, the refrigerant discharge capability of the compressor 11 is made larger by a predetermined amount than in the single parallel dehumidification heating mode. In addition, the control device 60 controls the bypass side flow rate adjustment valve 14*d* so as to have a predetermined opening degree that has been determined in advance for the single parallel hot gas dehumidification heating mode. In addition, the control device 60 stops the low-temperature side pump. The other control target equipment are controlled similarly in the cooling parallel dehumidification heating mode.

Accordingly, in the heat pump cycle 10 in the single parallel hot gas dehumidification heating mode, a vapor compression refrigeration cycle is configured in which the water-refrigerant heat exchanger 13 is caused to function as a condenser and the outdoor heat exchanger 15 and the indoor evaporator 18 are caused to function as evaporators. In the single parallel hot gas dehumidification heating mode, however, frost is formed in the outdoor heat exchanger 15, and thus the refrigerant having flowed into the outdoor heat exchanger 15 rarely absorbs heat from the outside air.

In the high-temperature side heat medium circuit 30 in the single parallel hot gas dehumidification heating mode, the high-temperature side heat medium heated by the water-refrigerant heat exchanger 13 is pumped to the heater core 32, similarly in the single air conditioning mode.

In the indoor air conditioning unit 50 in the single parallel hot gas dehumidification heating mode, the ventilation air cooled and dehumidified by the indoor evaporator 18 is reheated by the heater core 32 and blown out into the vehicle interior. As a result, dehumidification heating of the vehicle interior is realized.

In the heat pump cycle 10 in the single parallel hot gas dehumidification heating mode, frost is formed in the outdoor heat exchanger 15, and thus the amount of heat absorbed from the outside air by the refrigerant in the outdoor heat exchanger 15 is smaller than in the single parallel dehumidification heating mode.

Furthermore, as the amount of heat absorbed from the outside air by the refrigerant in the outdoor heat exchanger 15 decreases, the amount of heat dissipated from the refrigerant to the high-temperature side heat medium in the water-refrigerant heat exchanger 13 can decrease. As a result, the heating capability for the ventilation air in the heater core 32 is likely to decrease.

On the other hand, in the single parallel hot gas dehumidification heating mode of the present embodiment, the bypass side flow rate adjustment valve 14*d* and the cooling expansion valve 14*c* are in the aperture state. This allows the refrigerant with relatively high enthalpy flowing out of the bypass side flow rate adjustment valve 14*d* to be merged into the refrigerant with relatively low enthalpy flowing out of the water-refrigerant heat exchanger 13.

Accordingly, in the heat pump cycle 10 in the single parallel hot gas dehumidification heating mode, a decrease in the amount of heat to be dissipated from the refrigerant to the high-temperature side heat medium in the water-refrigerant heat exchanger 13 can be suppressed by increasing the refrigerant discharge capability of the compressor 11, as compared with in the parallel dehumidification heating mode.

As a result, in the single parallel hot gas dehumidification heating mode, a decrease in the heating capability for the ventilation air can be suppressed even if frost is formed in the outdoor heat exchanger 15 during the execution of the single parallel dehumidification heating mode.

(d-2) Cooling Parallel Hot Gas Dehumidification Heating Mode

In the heat pump cycle 10 in the cooling parallel hot gas dehumidification heating mode, the refrigerant discharged from the compressor 11 circulates similarly in the single parallel hot gas dehumidification heating mode.

Furthermore, the control device 60 appropriately controls the operations of the other control target equipment, similarly in the single parallel hot gas dehumidification heating mode.

Accordingly, in the heat pump cycle 10 in the cooling parallel hot gas dehumidification heating mode, a vapor compression refrigeration cycle is configured in which the water-refrigerant heat exchanger 13 is caused to function as a condenser and the outdoor heat exchanger 15, the indoor evaporator 18, and the chiller 20 are caused to function as evaporators.

In the high-temperature side heat medium circuit 30 in the cooling parallel hot gas dehumidification heating mode, the high-temperature side heat medium heated by the water-refrigerant heat exchanger 13 is pumped to the heater core 32, similarly in the single air conditioning mode.

In the low-temperature side heat medium circuit 40 in the cooling parallel hot gas dehumidification heating mode, the low-temperature side heat medium cooled by the chiller 20 flows through the cooling water passage 70*a* of the battery 70, whereby the battery 70 is cooled, similarly in the cooling air-conditioning mode.

In the indoor air conditioning unit 50 in the cooling parallel hot gas dehumidification heating mode, the ventilation air cooled and dehumidified by the indoor evaporator 18 is reheated by the heater core 32 and blown out into the vehicle interior. As a result, dehumidification heating of the vehicle interior is realized.

In the cooling parallel hot gas dehumidification heating mode, frost is formed in the outdoor heat exchanger 15, and thus the refrigerant having flowed into the outdoor heat exchanger 15 rarely absorbs heat from the outside air. On the other hand, in the cooling parallel hot gas dehumidification heating mode, the bypass side flow rate adjustment valve 14*d* is in the aperture state, and thus a decrease in the heating capability for the ventilation air can be suppressed, similarly in the single parallel hot gas dehumidification heating mode.

(e) Outside Air Heat Absorption Heating Mode

An outside air heat absorption heating mode is an operation mode for heating the vehicle interior by blowing out the heated ventilation air into the vehicle interior. In the control program of the present embodiment, the outside air heat absorption heating mode is selected when the outside air temperature Tam is a relatively low value (in the present embodiment, −10° C. or higher and lower than 0° C.) as mainly in winter.

The outside air heat absorption heating mode includes a single outside air heat absorption heating mode for heating the vehicle interior without cooling the battery 70, and a cooling outside air heat absorption heating mode for cooling the battery 70 and heating the vehicle interior.

(e-1) Single Outside Air Heat Absorption Heating Mode

In the heat pump cycle 10 in the single outside air heat absorption heating mode, the control device 60 brings the heating expansion valve 14*a* into an aperture state, brings the air conditioning expansion valve 14*b* into a fully closed state, brings the cooling expansion valve 14*c* into a fully closed state, and brings the bypass side flow rate adjustment valve 14*d* into a fully closed state. In addition, the control device 60 closes the dehumidification on-off valve 22*a* and opens the heating on-off valve 22*b*.

Therefore, in the heat pump cycle 10 in the single outside air heat absorption heating mode, a refrigerant circuit is switched to in which the refrigerant discharged from the compressor 11 circulates through the water-refrigerant heat exchanger 13, the heating expansion valve 14*a* in the aperture state, the outdoor heat exchanger 15, the heating passage 21*c*, the accumulator 23, and the suction port of the compressor 11 in this order.

In the high-temperature side heat medium circuit 30 in the single outside air heat absorption heating mode, the control device 60 controls the operation of the high-temperature side pump 31, similarly in the single air conditioning mode.

In the indoor air conditioning unit 50 in the single outside air heat absorption heating mode, the control device 60 controls the air blowing capability of the indoor blower 52, the opening degree of the air mix door 54, and the operations of the inside/outside air switching device 53 and the blowout mode door, similarly in the single air conditioning mode. In addition, the control device 60 appropriately controls the operations of the other control target equipment.

Accordingly, in the heat pump cycle 10 in the single outside air heat absorption heating mode, a vapor compression refrigeration cycle is configured in which the water-refrigerant heat exchanger 13 is caused to function as a condenser and the outdoor heat exchanger 15 is caused to function as an evaporator.

In the high-temperature side heat medium circuit 30 in the single outside air heat absorption heating mode, the high-temperature side heat medium heated by the water-refrigerant heat exchanger 13 is pumped to the heater core 32, similarly in the single air conditioning mode.

In the indoor air conditioning unit 50 in the single outside air heat absorption heating mode, the ventilation air blown from the indoor blower 52 passes through the indoor evaporator 18. The ventilation air having passed through the indoor evaporator 18 is heated by the heater core 32 in accordance with the opening degree of the air mix door 54 such that the ventilation air temperature TAV approaches the target air temperature TAO. Then, the ventilation air whose temperature has been adjusted is blown out into the vehicle interior, whereby heating of the vehicle interior is realized.

(e-2) Cooling Outside Air Heat Absorption Heating Mode

In the heat pump cycle 10 in the cooling outside air heat absorption heating mode, the control device 60 brings the cooling expansion valve 14*c* into an aperture state, contrary to the single outside air heat absorption heating mode. In addition, the control device 60 opens the dehumidification on-off valve 22*a*.

Therefore, in the heat pump cycle 10 in the cooling outside air heat absorption heating mode, the refrigerant discharged from the compressor 11 circulates similarly in the single outside air heat absorption heating mode. At the same time, a refrigerant circuit is switched to in which the refrigerant discharged from the compressor 11 circulates through the water-refrigerant heat exchanger 13, the dehumidification passage 21*b*, the cooling expansion valve 14*c* in the aperture state, the chiller 20, the accumulator 23, and the suction port of the compressor 11 in this order. That is, a refrigerant circuit is switched to in which the outdoor heat exchanger 15 and the chiller 20 are connected in parallel for the flow of the refrigerant.

In the high-temperature side heat medium circuit 30 in the cooling outside air heat absorption heating mode, the control device 60 controls the operation of the high-temperature side pump 31, similarly in the single air conditioning mode.

In the low-temperature side heat medium circuit 40 in the cooling outside air heat absorption heating mode, the control device 60 controls the operation of the low-temperature side pump 41, similarly in the cooling air-conditioning mode.

In the indoor air conditioning unit 50 in the cooling outside air heat absorption heating mode, the control device 60 controls the air blowing capability of the indoor blower 52, the opening degree of the air mix door 54, and the operations of the inside/outside air switching device 53 and the blowout mode door, similarly in the single air conditioning mode. In addition, the control device 60 appropriately controls the operations of the other control target equipment.

Accordingly, in the heat pump cycle 10 in the cooling outside air heat absorption heating mode, a vapor compression refrigeration cycle is configured in which the water-refrigerant heat exchanger 13 is caused to function as a condenser and the outdoor heat exchanger 15 and the chiller 20 are caused to function as evaporators.

In the high-temperature side heat medium circuit 30 in the cooling outside air heat absorption heating mode, the high-temperature side heat medium heated by the water-refrigerant heat exchanger 13 is pumped to the heater core 32, similarly in the single air conditioning mode.

In the low-temperature side heat medium circuit 40 in the cooling outside air heat absorption heating mode, the low-temperature side heat medium cooled by the chiller 20 flows through the cooling water passage 70*a* of the battery 70, whereby the battery 70 is cooled, similarly in the cooling air-conditioning mode.

In the indoor air conditioning unit 50 in the cooling outside air heat absorption heating mode, the ventilation air whose temperature has been adjusted is blown out into the vehicle interior, whereby heating of the vehicle interior is realized, similarly in the single outside air heat absorption heating mode.

(f) Outside Air Heat Absorption Hot Gas Heating Mode

An outside air heat absorption hot gas heating mode is an operation mode to be executed to suppress a decrease in the heating capability for the ventilation air when it is determined that frost has been formed in the outdoor heat exchanger 15 during the execution of the outside air heat absorption heating mode. In the control program of the present embodiment, it is determined that frost has been formed in the outdoor heat exchanger 15 when a frost formation condition, similar in the parallel hot gas dehumidification heating mode, is satisfied.

The outside air heat absorption hot gas heating mode includes a single outside air heat absorption hot gas heating mode and a cooling outside air heat absorption hot gas heating mode. The single outside air heat absorption hot gas heating mode is executed when the frost formation condition is satisfied during the execution of the single outside air heat absorption heating mode. The cooling outside air heat absorption hot gas heating mode is executed when the frost formation condition is satisfied during the execution of the cooling outside air heat absorption heating mode.

(f-1) Single Outside Air Heat Absorption Hot Gas Heating Mode

In the heat pump cycle 10 in the single outside air heat absorption hot gas heating mode, the control device 60 brings the bypass side flow rate adjustment valve 14*d* into an aperture state and brings the cooling expansion valve 14*c* into an aperture state, contrary to the single outside air heat absorption heating mode.

Therefore, in the heat pump cycle 10 in the single outside air heat absorption hot gas heating mode, the refrigerant discharged from the compressor 11 circulates similarly in the cooling outside air heat absorption heating mode. At the same time, a refrigerant circuit is switched to in which a part of the refrigerant discharged from the compressor 11 circulates through the bypass side flow rate adjustment valve 14*d* in the aperture state, the chiller 20, the accumulator 23, and the suction port of the compressor 11 in this order.

Furthermore, the control device 60 appropriately controls the operations of the other control target equipment. For example, the refrigerant discharge capability of the compressor 11 is made larger by a predetermined amount than in the single outside air heat absorption heating mode. The control device 60 controls the bypass side flow rate adjustment valve 14*d* so as to have a predetermined opening degree for the single outside air heat absorption hot gas heating mode. In addition, the control device 60 stops the low-temperature side pump. The other control target equipment are controlled similarly in the cooling outside air heat absorption heating mode.

Accordingly, in the heat pump cycle 10 in the single outside air heat absorption hot gas heating mode, a vapor compression refrigeration cycle is configured in which the water-refrigerant heat exchanger 13 is caused to function as a condenser and the outdoor heat exchanger 15 is caused to function as an evaporator, similarly in the cooling outside air heat absorption heating mode. In the single outside air heat absorption hot gas heating mode, however, frost is formed in the outdoor heat exchanger 15, and thus the refrigerant having flowed into the outdoor heat exchanger 15 rarely absorbs heat from the outside air.

In the high-temperature side heat medium circuit 30 in the single outside air heat absorption hot gas heating mode, the high-temperature side heat medium heated by the water-refrigerant heat exchanger 13 is pumped to the heater core 32, similarly in the single air conditioning mode.

In the indoor air conditioning unit 50 in the single outside air heat absorption hot gas heating mode, the ventilation air having passed through the indoor evaporator 18 is heated by the heater core 32 and blown out into the vehicle interior. As a result, heating of the vehicle interior is realized.

In the heat pump cycle 10 in the single outside air heat absorption hot gas heating mode, frost is formed in the outdoor heat exchanger 15, and thus the amount of heat absorbed from the outside air by the refrigerant in the outdoor heat exchanger 15 is smaller than in the single outside air heat absorption heating mode.

Furthermore, as the amount of heat absorbed from the outside air by the refrigerant in the outdoor heat exchanger 15 decreases, the amount of heat to be dissipated from the refrigerant to the high-temperature side heat medium in the water-refrigerant heat exchanger 13 can decrease. As a result, the heating capability for the ventilation air in the heater core 32 is likely to decrease.

On the other hand, in the single outside air heat absorption hot gas heating mode of the present embodiment, the bypass side flow rate adjustment valve 14*d* and the cooling expansion valve 14*c* are in the aperture state. This allows the refrigerant with relatively high enthalpy flowing out of the bypass side flow rate adjustment valve 14*d* to be merged into the refrigerant with relatively low enthalpy flowing out of the water-refrigerant heat exchanger 13, similarly in the parallel hot gas dehumidification heating mode.

Accordingly, in the heat pump cycle 10 in the single outside air heat absorption hot gas heating mode, a decrease in the amount of heat to be dissipated from the refrigerant to the high-temperature side heat medium in the water-refrigerant heat exchanger 13 can be suppressed by increasing the refrigerant discharge capability of the compressor 11, similarly in the parallel hot gas dehumidification heating mode.

As a result, in the single outside air heat absorption hot gas heating mode, a decrease in the heating capability for the ventilation air can be suppressed even if frost is formed in the outdoor heat exchanger 15 during the execution of the single outside air heat absorption heating mode.

(f-2) Cooling Outside Air Heat Absorption Hot Gas Heating Mode

In the heat pump cycle 10 in the cooling outside air heat absorption hot gas heating mode, the refrigerant circulates similarly in the cooling outside air heat absorption heating mode. Furthermore, the control device 60 appropriately controls the operations of the other control target equipment.

Accordingly, in the heat pump cycle 10 in the cooling outside air heat absorption hot gas heating mode, a vapor compression refrigeration cycle is configured in which the water-refrigerant heat exchanger 13 is caused to function as a condenser and the outdoor heat exchanger 15 and the chiller 20 are caused to function as evaporators.

In the high-temperature side heat medium circuit 30 in the cooling outside air heat absorption hot gas heating mode, the high-temperature side heat medium heated by the water-refrigerant heat exchanger 13 is pumped to the heater core 32, similarly in the single air conditioning mode.

In the low-temperature side heat medium circuit 40 in the cooling outside air heat absorption hot gas heating mode, the low-temperature side heat medium cooled by the chiller 20 flows through the cooling water passage 70*a* of the battery 70, whereby the battery 70 is cooled, similarly in the cooling air-conditioning mode.

In the indoor air conditioning unit 50 in the cooling outside air heat absorption hot gas heating mode, the ventilation air having passed through the indoor evaporator 18 is heated by the heater core 32 and blown out into the vehicle interior. As a result, heating of the vehicle interior is realized.

In the cooling outside air heat absorption hot gas dehumidification heating mode, frost is formed in the outdoor heat exchanger 15, and thus the refrigerant having flowed into the outdoor heat exchanger 15 rarely absorbs heat from the outside air. On the other hand, in the cooling outside air heat absorption hot gas heating mode, the bypass side flow rate adjustment valve 14*d* is in the aperture state, so that a decrease in the heating capability for the ventilation air can be suppressed, similarly in the single outside air heat absorption hot gas heating mode.

(g) Hot Gas Heating Mode

A hot gas heating mode is an operation mode for heating the vehicle interior when the outside air temperature Tam is extremely low (in the present embodiment, lower than −10° C.). In the control program of the present embodiment, the hot gas heating mode is selected when the outside air temperature Tam is extremely low and the air conditioner switch is in a non-input state (OFF).

The hot gas heating mode is included in a hot gas mode in which the operations of the control target equipment are controlled such that the ventilation air temperature TAV approaches the target air temperature TAO and the operations of the control target equipment are controlled such that the sucked refrigerant pressure Ps detected by the sucked refrigerant temperature pressure sensor 62*f* approaches a target low pressure PSO.

Figure 4:
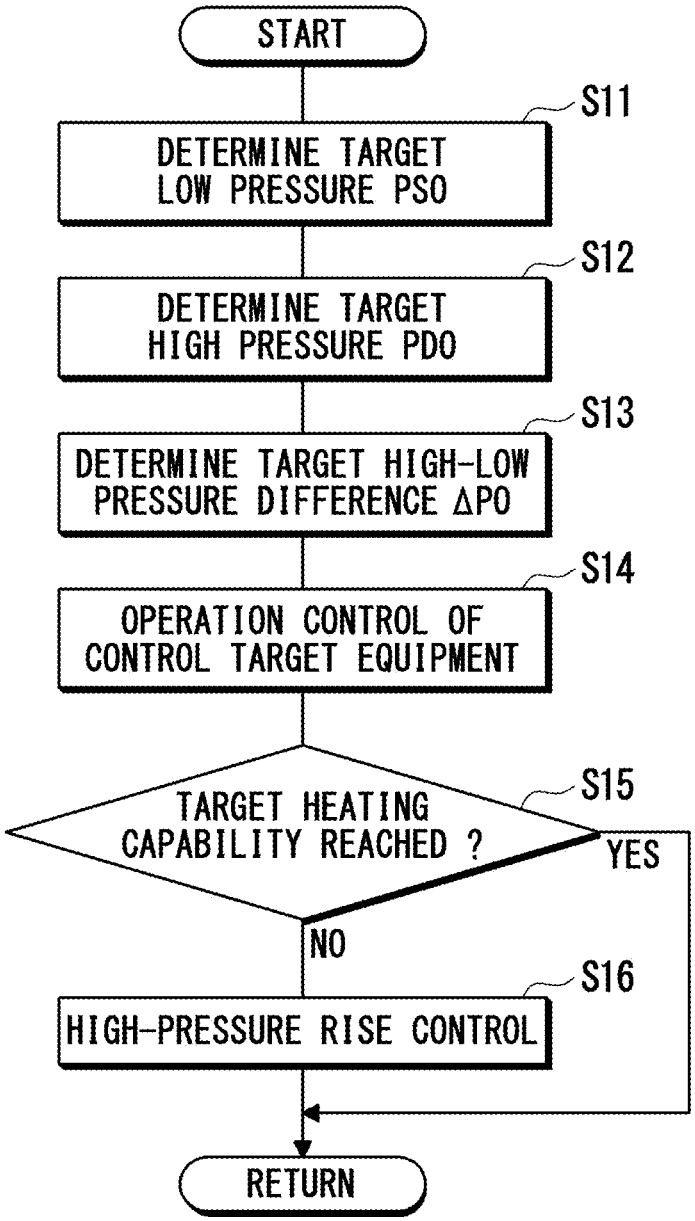
FIG. 4 is a flowchart of a subroutine of the control program according to the first embodiment.

Therefore, in the hot gas heating mode, a control process in the hot gas mode shown in the flowchart of FIG. 4 is executed. In more detail, the flowchart shown in FIG. 4 is a control process to be executed, when an operation mode in which the control process in the hot gas mode is executed is selected in the step S4 of the main routine, as a subroutine in the step S5.

First, in a step S11 in FIG. 4, the target low pressure PSO that is the target value of the sucked refrigerant pressure Ps is determined in accordance with the selected operation mode. Accordingly, the step S11 is a target low-pressure determination part. In the step S11 in the hot gas heating mode, the target low pressure PSO is determined to be a predetermined hot gas heating mode target value.

Here, controlling the sucked refrigerant pressure Ps so as to approach a constant value is effective for stabilizing a discharge flow rate Gr (mass flow rate) of the compressor 11. In more detail, the density of the sucked refrigerant becomes constant by setting the sucked refrigerant pressure Ps to a saturated gas-phase refrigerant with constant pressure. Accordingly, when the sucked refrigerant pressure Ps is controlled to approach a constant pressure, the discharge flow rate Gr of the compressor 11 at the same rotation speed is easily stabilized.

Next, in a step S12, a target high pressure PDO, which is a target value of the discharged refrigerant pressure Pd detected by the discharged refrigerant temperature pressure sensor 62*a*, is determined. Accordingly, the step S11 is a target high-pressure determination part. In the step S12, the target high pressure PDO is determined based on the target air temperature TAO and with reference to the control map stored in advance in the control device 60.

Next, in a step S13, a target high-low pressure difference ΔPO, which is a target value of a high-low pressure difference ΔP, is determined. It is a value obtained by subtracting the sucked refrigerant pressure Ps from the discharged refrigerant pressure Pd. Accordingly, the step S13 is a target high-low pressure difference determination part.

Here, in a hot gas heating mode control map, the target high pressure PDO is determined to be increased as the target air temperature TAO rises. Furthermore, in the hot gas heating mode control map, the target high pressure PDO is determined such that the target high-low pressure difference ΔPO becomes a value equal to or larger than a predetermined reference high-low pressure difference ΔPmin. The reference high-low pressure difference ΔPmin is determined such that the workload of the compressor 11 becomes equal to or larger than a predetermined reference workload.

Next, in a step S14, the operation of each control target equipment is controlled in accordance with the selected operation mode. In other words, the normal control in the hot gas mode is executed in accordance with the selected operation mode.

Next, in a step S15, it is determined whether the heating capability exhibited by the vehicle air conditioner 1 has reached target heating capability that can raise the ventilation air temperature TAV to the target air temperature TAO.

When it is determined in the step S15 that the heating capability has reached the target heating capability, the process returns to the main routine. When it is determined in the step S15 that the heating capability is below the target heating capability, the process proceeds to a step S16. In the step S16, the high-pressure rise control is executed, and the process returns to the main routine.

In the step S15 of the present embodiment, when the ventilation air temperature TAV is lower than the target air temperature TAO and the rotation speed (i.e., refrigerant discharge capability) of the compressor 11 is equal to or higher than a predetermined reference rotation speed (i.e., reference capability), it is determined that the heating capability is below the target heating capability. In the present embodiment, a maximum rotation speed determined from the durability performance of the compressor 11 is adopted as the reference rotation speed.

Furthermore, in the step S15 of the present embodiment, it is determined that the heating capability is below the target heating capability when the ventilation air temperature TAV is lower than the target air temperature TAO and the throttle opening degree of the bypass side flow rate adjustment valve 14*d* is equal to or less than a predetermined reference opening degree. In the present embodiment, a minimum opening degree, that can be realized in terms of control by a control signal output from the control device 60, is adopted as the reference opening degree.

Next, the normal control executed in the step S14 in the hot gas heating mode will be described.

In the heat pump cycle 10 in the hot gas heating mode, the control device 60 brings the heating expansion valve 14*a* into a fully closed state, brings the air conditioning expansion valve 14*b* into a fully closed state, brings the cooling expansion valve 14*c* into an aperture state, and brings the bypass side flow rate adjustment valve 14*d* into an aperture state. In addition, the control device 60 opens the dehumidification on-off valve 22*a* and closes the heating on-off valve 22*b*.

Figure 5:
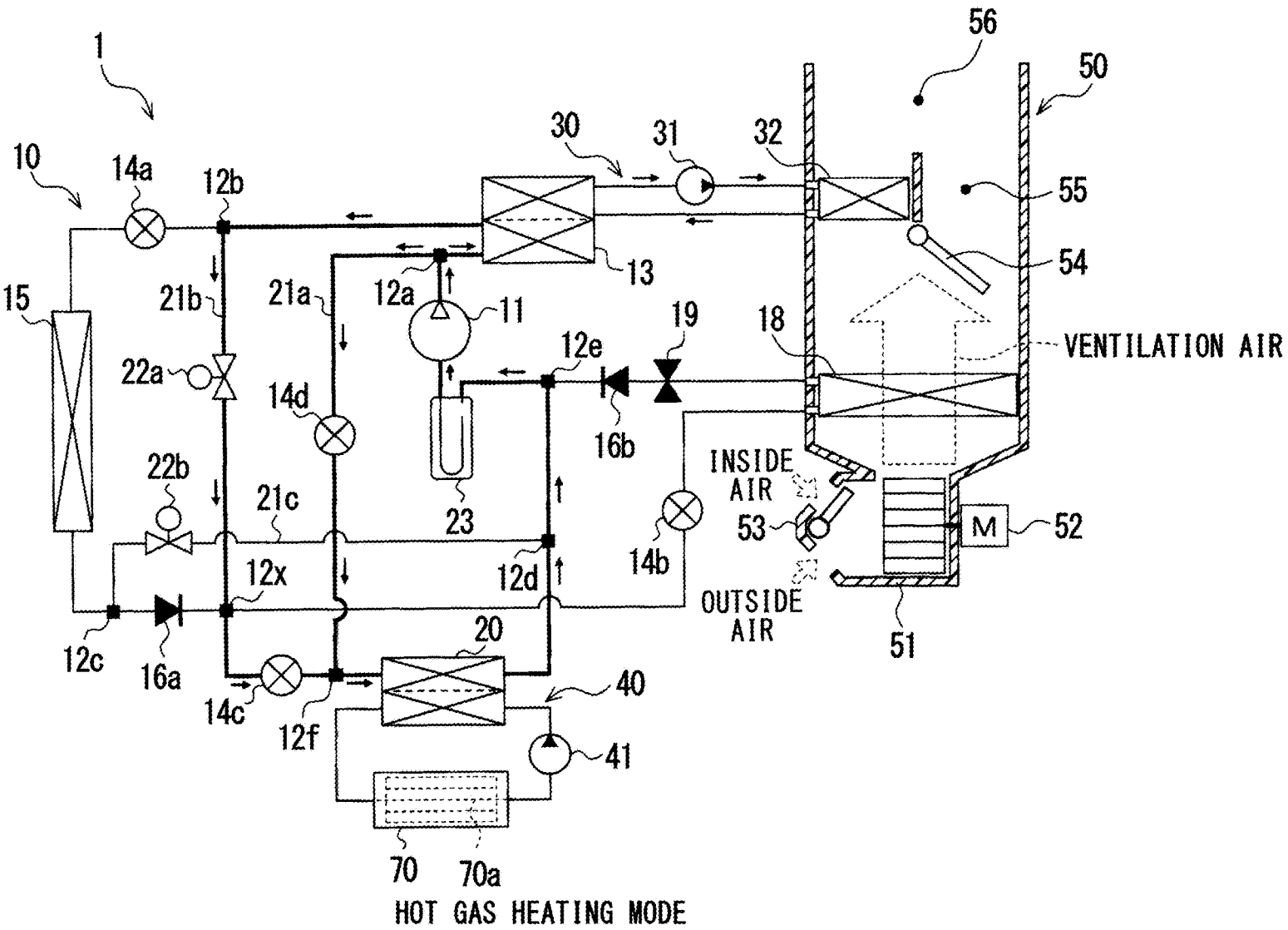
FIG. 5 is a schematic overall configuration diagram showing a flow of a refrigerant in a hot gas heating mode of a heat pump cycle according to the first embodiment.

Therefore, in the heat pump cycle 10 in the hot gas heating mode, the refrigerant discharged from the compressor 11 circulates through the first three-way joint 12*a*, the water-refrigerant heat exchanger 13, the dehumidification passage 21*b*, the four-way joint 12*x*, the cooling expansion valve 14*c* in the aperture state, the sixth three-way joint 12*f*, the chiller 20, the accumulator 23, and the suction port of the compressor 11 in this order, as indicated by the solid arrows in FIG. 5. At the same time, a refrigerant circuit is switched to in which the refrigerant discharged from the compressor 11 circulates through the first three-way joint 12*a*, the bypass side flow rate adjustment valve 14*d* in the aperture state disposed in the bypass passage 21*a*, the sixth three-way joint 12*f*, the chiller 20, the accumulator 23, and the suction port of the compressor 11 in this order.

Accordingly, in the hot gas heating mode, the cooling expansion valve 14*c* serves as the heating-unit side decompression unit, and the sixth three-way joint 12*f* serves as a mixing part.

Furthermore, the control device 60 appropriately controls the operations of the other control target equipment. Specifically, regarding the compressor 11, the control device 60 controls the refrigerant discharge capability (i.e., the rotation speed) of the compressor 11 such that the sucked refrigerant pressure Ps approaches the target low pressure PSO.

The control device 60 adjusts the throttle opening degree of the cooling expansion valve 14*c* such that a subcooling degree SC1 of the refrigerant flowing out of the water-refrigerant heat exchanger 13 approaches a first target subcooling degree SCO1. The subcooling degree SC1 can be obtained from the high-pressure side refrigerant temperature T1 and the high-pressure side refrigerant pressure P1 detected by the high-pressure side refrigerant temperature pressure sensor 62*b*. The first target subcooling degree SCO1 is determined with reference to the control map stored in advance in the control device 60.

In addition, the control device 60 adjusts the throttle opening degree of the bypass side flow rate adjustment valve 14*d* such that the high-low pressure difference ΔP approaches the target high-low pressure difference ΔPO. More specifically, in the present embodiment, the throttle opening degree of the bypass side flow rate adjustment valve 14*d* is adjusted such that the high-low pressure difference ΔP becomes equal to or larger than the target high-low pressure difference ΔPO.

As described above, the target high-low pressure difference ΔPO is determined using the target high pressure PDO correlated with the target air temperature TAO. Accordingly, adjusting the throttle opening degree of the bypass side flow rate adjustment valve 14*d* such that the high-low pressure difference ΔP approaches the target high-low pressure difference ΔPO means that the throttle opening degree of the bypass side flow rate adjustment valve 14*d* is adjusted such that the ventilation air temperature TAV approaches the target air temperature TAO.

In the high-temperature side heat medium circuit 30 in the hot gas heating mode, the control device 60 controls the operation of the high-temperature side pump 31, similarly in the single air conditioning mode.

In the low-temperature side heat medium circuit 40 in the hot gas heating mode, the control device 60 stops the low-temperature side pump 41.

In the indoor air conditioning unit 50 in the hot gas heating mode, the control device 60 controls the opening degree of the air mix door 54, similarly in the single air conditioning mode. In the hot gas heating mode, the control device 60 often controls the opening degree of the air mix door 54 such that almost the entire air volume of the ventilation air blown from the indoor blower 52 passes through the heater core 32.

The control device 60 controls the operation of the inside/outside air switching device 53 so as to introduce the inside air into the air conditioning case 51.

In addition, the control device 60 controls the air blowing capability of the indoor blower 52, the opening degree of the air mix door 54, and the operation of the blowout mode door, similarly in the single air conditioning mode.

Figure 6:
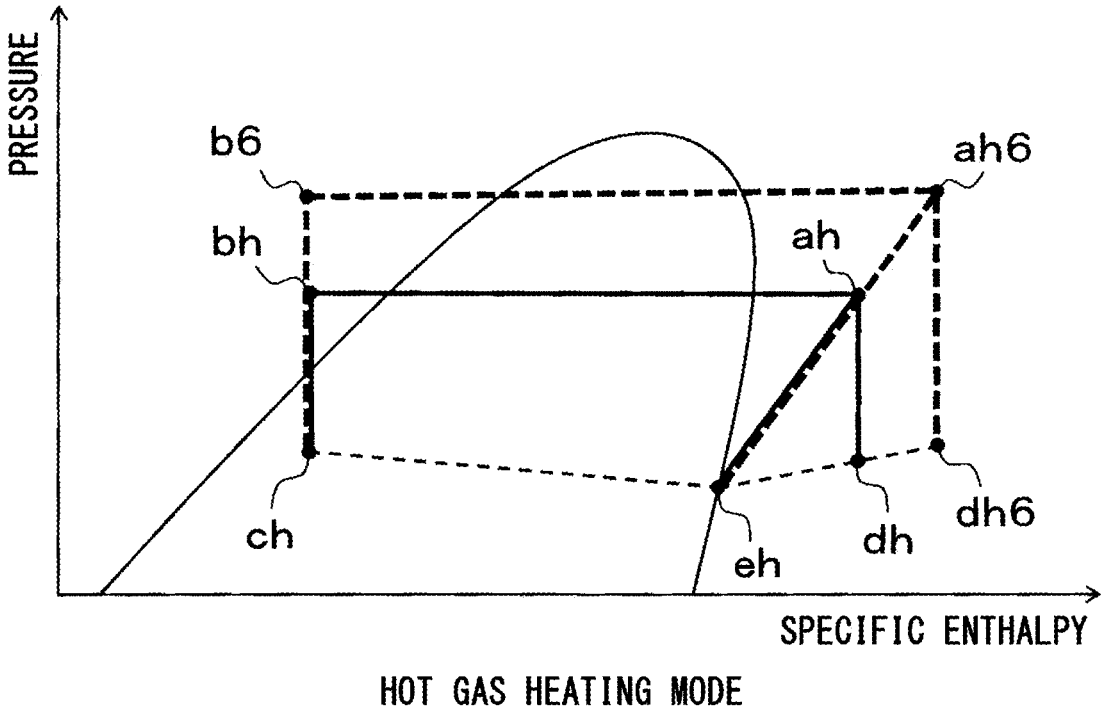
FIG. 6 is a Mollier diagram showing a change in a state of the refrigerant in the hot gas heating mode of the heat pump cycle according to the first embodiment.

Accordingly, in the heat pump cycle 10 in the hot gas heating mode, the state of the refrigerant changes as indicated by the thick solid lines in the Mollier diagram in FIG. 6.

That is, the flow of the discharged refrigerant (a point ah in FIG. 6) discharged from the compressor 11 is branched at the first three-way joint 12*a*. One of the refrigerants branched at the first three-way joint 12*a* flows into the water-refrigerant heat exchanger 13, and dissipates heat to the high-temperature side heat medium (from the point ah to a point bh in FIG. 6). As a result, the high-temperature side heat medium is heated.

The refrigerant flowing out of the water-refrigerant heat exchanger 13 flows into the dehumidification passage 21*b*. Since the air conditioning expansion valve 14*b* is in a fully closed state, the refrigerant having flowed into the dehumidification passage 21*b* flows into the cooling expansion valve 14*c* and is decompressed (from the point bh to a point ch in FIG. 6). The refrigerant with relatively low enthalpy flowing out of the cooling expansion valve 14*c* flows into the other of the inflow ports of the sixth three-way joint 12*f*.

The other of the refrigerants branched at the first three-way joint 12*a* flows into the bypass passage 21*a*. The refrigerant having flowed into the bypass passage 21*a* is adjusted in flow rate and decompressed (from the point ah to a point dh in FIG. 6) by the bypass side flow rate adjustment valve 14*d*. The refrigerant with relatively high enthalpy decompressed by the bypass side flow rate adjustment valve 14*d* flows into the one of the inflow ports of the sixth three-way joint 12*f*.

The refrigerant flowing out of the bypass side flow rate adjustment valve 14*d* is mixed with the refrigerant flowing out of the cooling expansion valve 14*c* at the sixth three-way joint 12*f*. The refrigerant flowing out of the sixth three-way joint 12*f* flows into the chiller 20. In the hot gas heating mode, the low-temperature side pump 41 is stopped, and thus the refrigerant having flowed into the chiller 20 is homogeneously mixed (a point eh in FIG. 6) by the chiller 20 when flowing through the refrigerant passage of the chiller 20, without exchanging heat with the low-temperature side heat medium.

The refrigerant flowing out of the refrigerant passage of the chiller 20 flows into the accumulator 23. The gas-phase refrigerant separated in the accumulator 23 is sucked into the compressor 11 and compressed again.

In the high-temperature side heat medium circuit 30 in the hot gas heating mode, the high-temperature side heat medium heated by the water-refrigerant heat exchanger 13 is pumped to the heater core 32, similarly in the single air conditioning mode.

In the indoor air conditioning unit 50 in the hot gas heating mode, the ventilation air having passed through the indoor evaporator 18 is heated by the heater core 32 and blown out into the vehicle interior. As a result, heating of the vehicle interior is realized.

Here, the hot gas heating mode is an operation mode to be executed when the outside air temperature Tam is extremely low. Therefore, when the refrigerant flowing out of the water-refrigerant heat exchanger 13 is caused to flow into the outdoor heat exchanger 15, the refrigerant can dissipate heat to the outside air in the outdoor heat exchanger 15. When the refrigerant has dissipated heat to the outside air, the amount of heat to be dissipated from the refrigerant to the ventilation air in the water-refrigerant heat exchanger 13 decreases, and the heating capability for the ventilation air decreases.

Contrary to this, in the hot gas heating mode of the present embodiment, a refrigerant circuit is configured in which the refrigerant flowing out of the water-refrigerant heat exchanger 13 is prevented from flowing into the outdoor heat exchanger 15, so that the refrigerant is suppressed from dissipating heat to the outside air in the outdoor heat exchanger 15. Accordingly, in the hot gas heating mode, the heat generated by the work of the compressor 11 can be effectively used to heat the ventilation air.

Next, the high-pressure rise control executed in the step S16 in the hot gas heating mode will be described.

Under the high-pressure rise control of the present embodiment, control for raising the subcooling degree of the refrigerant flowing out of the refrigerant passage of the water-refrigerant heat exchanger 13 is performed. More specifically, in the step S16, the throttle opening degree of the cooling expansion valve 14*c*, which is the heating-unit side decompression unit, is made smaller than the throttle opening degree determined in the step S14. Regarding the other control target equipment, the operation states determined in the step S14 are maintained.

Accordingly, in the heat pump cycle 10 under the high-pressure rise control, the state of the refrigerant changes as indicated by the thick dashed lines in the Mollier diagram in FIG. 6. That is, the throttle opening degree of the cooling expansion valve 14*c* is made small, and thus the pressure of the discharged refrigerant (a point ah6 in FIG. 6) discharged from the compressor 11 rises beyond that under the normal control.

Therefore, the one of the refrigerants branched at the first three-way joint 12*a* flows into the water-refrigerant heat exchanger 13, and dissipates heat to the high-temperature side heat medium (from the point ah6 to a point bh6 in FIG. 6) at a pressure higher than under the normal control. As a result, the high-temperature side heat medium is heated to a temperature higher than under the normal control. The refrigerant flowing out of the water-refrigerant heat exchanger 13 flows into cooling expansion valve 14*c* and is decompressed (from the point bh6 to the point ch in FIG. 6).

The other of the refrigerants branched at the first three-way joint 12*a* is adjusted in flow rate and decompressed (from the point ah6 to a point dh6 in FIG. 6) by the bypass side flow rate adjustment valve 14*d* in the bypass passage 21*a*. The refrigerant flowing out of the bypass side flow rate adjustment valve 14*d* is mixed with the refrigerant flowing out of the cooling expansion valve 14*c* at the sixth three-way joint 12*f*.

The other operations are similar to those under the normal control. Accordingly, under the high-pressure rise control, the temperature of the high-temperature side heat medium can be made higher than under the normal control. As a result, the ventilation air temperature TAV can be brought closer to the target air temperature TAO by raising the temperature of the ventilation air to be heated by the heater core 32.

(h) Temperature Adjustment Hot Gas Heating Mode

A temperature adjustment hot gas heating mode is an operation mode for adjusting the temperature of the battery 70 during the execution of the hot gas heating mode. The temperature adjustment hot gas heating mode includes a cooling hot gas heating mode for cooling the battery 70 and a warm-up hot gas heating mode for warming up the battery 70.

In the control program of the present embodiment, the cooling hot gas heating mode is selected when, during the execution of the hot gas heating mode, the battery temperature TB is equal to or higher than the reference upper limit temperature KTBH and the sucked refrigerant temperature Ts is lower than the low-temperature side heat medium temperature TWL detected by the low-temperature side heat medium temperature sensor 63*b*.

In the control program of the present embodiment, the warm-up hot gas heating mode is selected when, during the execution of the hot gas heating mode, the battery temperature TB is equal to or lower than the reference lower limit temperature KTBL and the sucked refrigerant temperature Ts is higher than the low-temperature side heat medium temperature TWL.

The temperature adjustment hot gas heating mode is included in the hot gas mode. Accordingly, in the temperature adjustment hot gas heating mode, the control process in the hot gas mode is executed.

(h-1) Cooling Hot Gas Heating Mode

Under the normal control executed in the step S14 in the cooling hot gas heating mode, the control device 60 operates the low-temperature side pump 41 so as to exhibit predetermined reference pumping capability, contrary to the hot gas heating mode. The other operations are similar to those in the hot gas heating mode.

Accordingly, in the cooling hot gas heating mode, the heat generated by the work of the compressor 11 can be effectively used to heat the ventilation air. When the heating capability is below the target heating capability, the ventilation air temperature TAV can be brought closer to the target air temperature TAO by executing the high-pressure rise control, similarly in the hot gas heating mode.

Furthermore, in the heat pump cycle 10 in the cooling hot gas heating mode, the refrigerant having flowed into the chiller 20 absorbs heat from the low-temperature side heat medium. As a result, the low-temperature side heat medium is cooled. In the low-temperature side heat medium circuit 40 in the cooling hot gas heating mode, the low-temperature side heat medium cooled by the chiller 20 flows through the cooling water passage 70*a* of the battery 70. As a result, the battery 70 can be cooled.

(h-2) Warm-Up Hot Gas Heating Mode

Under the normal control executed in step the S14 in the warm-up hot gas heating mode, the control device 60 operates the low-temperature side pump 41 so as to exhibit predetermined reference pumping capability, contrary to the hot gas heating mode. The other operations are similar to those in the hot gas heating mode.

Accordingly, in the warm-up hot gas heating mode, the heat generated by the work of the compressor 11 can be effectively used to heat the ventilation air. When the heating capability is below the target heating capability, the ventilation air temperature TAV can be brought closer to the target air temperature TAO by executing the high-pressure rise control, similarly in the hot gas heating mode.

Furthermore, in the heat pump cycle 10 in the warm-up hot gas heating mode, the refrigerant having flowed into the chiller 20 dissipates heat to the low-temperature side heat medium. As a result, the low-temperature side heat medium is heated. In the low-temperature side heat medium circuit 40 in the warm-up hot gas heating mode, the low-temperature side heat medium heated by the chiller 20 flows through the cooling water passage 70*a* of the battery 70. As a result, the battery 70 can be warmed up.

(i) Hot Gas Dehumidification Heating Mode

A hot gas dehumidification heating mode is an operation mode for dehumidification heating the vehicle interior when the outside air temperature Tam is low. In the control program of the present embodiment, the hot gas dehumidification heating mode is selected when the outside air temperature Tam becomes a temperature within a low-to-middle temperature range (in the present embodiment, 0° C. or higher and lower than 10° C.) and the air conditioner switch is in an input state (ON).

The hot gas dehumidification heating mode is included in the hot gas mode. Accordingly, in the hot gas dehumidification heating mode, the control process in the hot gas mode is executed. The hot gas dehumidification heating mode includes a single hot gas dehumidification heating mode for dehumidification heating the vehicle interior without cooling the battery 70, and a cooling hot gas dehumidification heating mode for cooling the battery 70 and dehumidification heating the vehicle interior.

(i-1) Single Hot Gas Dehumidification Heating Mode

First, the normal control executed in the step S14 in the single hot gas dehumidification heating mode will be described. In the heat pump cycle 10 in the single hot gas dehumidification heating mode, the control device 60 brings the heating expansion valve 14*a* into a fully closed state, brings the air conditioning expansion valve 14*b* into an aperture state, brings the cooling expansion valve 14*c* into an aperture state, and brings the bypass side flow rate adjustment valve 14*d* into an aperture state. In addition, the control device 60 opens the dehumidification on-off valve 22*a* and closes the heating on-off valve 22*b*.

Figure 7:
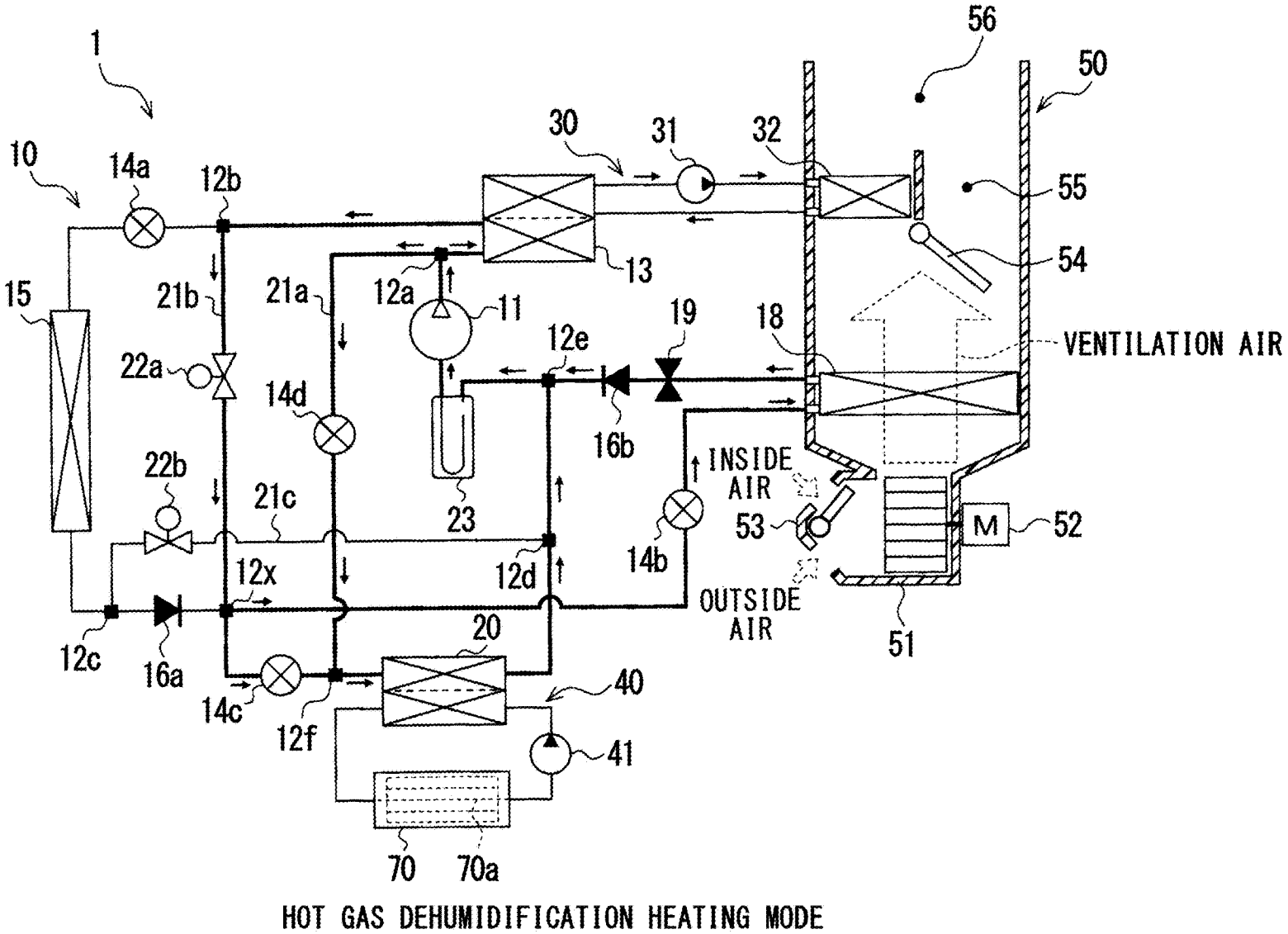
FIG. 7 is a schematic overall configuration diagram showing a flow of the refrigerant in a hot gas dehumidification heating mode of the heat pump cycle according to the first embodiment.

Therefore, in the heat pump cycle 10 in the single hot gas dehumidification heating mode, the refrigerant discharged from the compressor 11 circulates similarly in the hot gas heating mode, as indicated by the solid arrows in FIG. 7. At the same time, a refrigerant circuit is switched to in which the refrigerant discharged from the compressor 11 circulates through the first three-way joint 12*a*, the water-refrigerant heat exchanger 13, the dehumidification passage 21*b*, the four-way joint 12*x*, the air conditioning expansion valve 14*b* in the aperture state, the indoor evaporator 18, the evaporation pressure adjustment valve 19, the accumulator 23, and the suction port of the compressor 11 in this order.

Accordingly, in the single hot gas dehumidification heating mode, the cooling expansion valve 14*c* serves as the heating-unit side decompression unit, and the sixth three-way joint 12*f* serves as the mixing part.

Furthermore, the control device 60 appropriately controls the operations of the other control target equipment. Specifically, regarding the compressor 11, the control device 60 controls the refrigerant discharge capability (i.e., the rotation speed) of the compressor 11 such that the sucked refrigerant pressure Ps approaches the target low pressure PSO. In the step S11 in the single hot gas dehumidification heating mode, the target low pressure PSO is determined with reference to the control map stored in advance in the control device 60.

The control device 60 adjusts the throttle opening degree of the cooling expansion valve 14*c* such that a subcooling degree SC1 of the refrigerant flowing out of the water-refrigerant heat exchanger 13 approaches a second target subcooling degree SCO2. The second target subcooling degree SCO2 is determined with reference to the control map stored in advance in the control device 60.

In addition, the control device 60 adjusts the throttle opening degree of the bypass side flow rate adjustment valve 14*d* such that the high-low pressure difference ΔP approaches the target high-low pressure difference ΔPO. More specifically, in the present embodiment, the throttle opening degree of the bypass side flow rate adjustment valve 14*d* is adjusted such that the high-low pressure difference ΔP becomes equal to or larger than the target high-low pressure difference ΔPO.

In the high-temperature side heat medium circuit 30 in the single hot gas dehumidification heating mode, the control device 60 controls the operation of the high-temperature side pump 31, similarly in the single air conditioning mode.

In the low-temperature side heat medium circuit 40 in the single hot gas dehumidification heating mode, the control device 60 stops the low-temperature side pump 41.

In the indoor air conditioning unit 50 in the single hot gas dehumidification heating mode, the control device 60 controls the opening degree of the air mix door 54, similarly in the single air conditioning mode. The control device 60 controls the operation of the inside/outside air switching device 53 so as to introduce the inside air into the air conditioning case 51. In addition, the control device 60 controls the air blowing capability of the indoor blower 52, the opening degree of the air mix door 54, and the operation of the blowout mode door, similarly in the single air conditioning mode.

Figure 8:
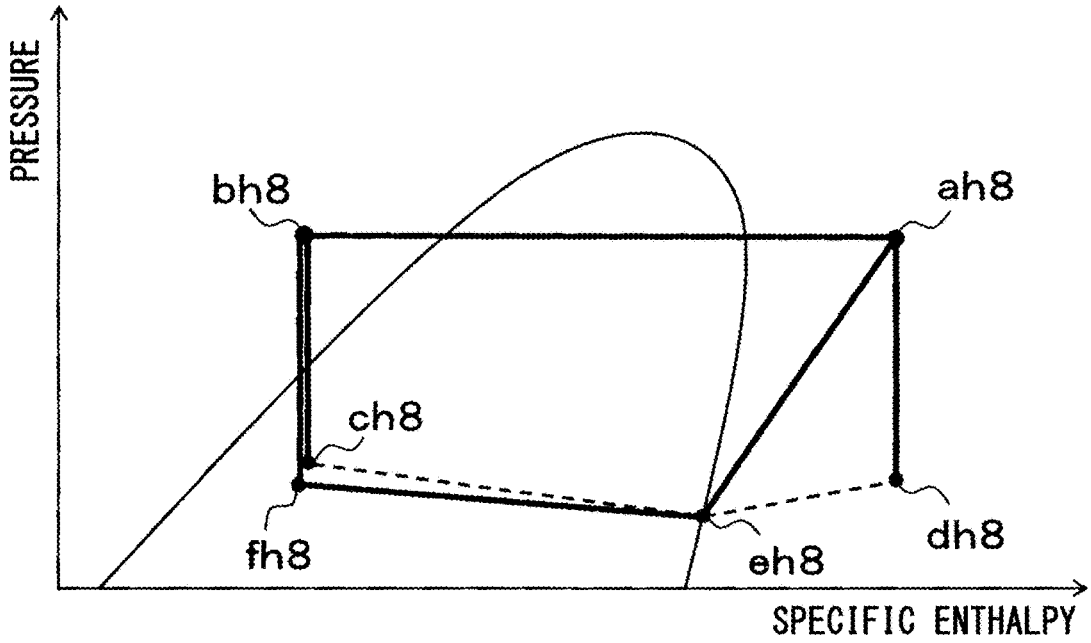
FIG. 8 is a Mollier diagram showing a change in a state of the refrigerant in the hot gas dehumidification heating mode of the heat pump cycle according to the first embodiment.

Accordingly, in the heat pump cycle 10 in the single hot gas dehumidification heating mode, the state of the refrigerant changes as shown in the Mollier diagram of FIG. 8.

That is, the flow of the discharged refrigerant (a point ah8 in FIG. 8) discharged from the compressor 11 is branched at the first three-way joint 12*a*. The one of the refrigerants branched at the first three-way joint 12*a* flows into the water-refrigerant heat exchanger 13, and dissipates heat to the high-temperature side heat medium (from the point ah8 to a point bh8 in FIG. 8).

The refrigerant flowing out of the water-refrigerant heat exchanger 13 flows into the one of the inflow ports of the four-way joint 12*x* via the dehumidification passage 21*b*.

The refrigerant flowing out of the one of the outflow ports of the four-way joint 12*x* flows into the air conditioning expansion valve 14*b* and is decompressed (from the point bh8 to a point fh8 in FIG. 8). The refrigerant decompressed by the air conditioning expansion valve 14*b* flows into the indoor evaporator 18.

The refrigerant having flowed into the indoor evaporator 18 exchanges heat with the ventilation air (In the present embodiment, inside air) blown from the indoor blower 52 and evaporates (from the point fh8 to a point eh8 in FIG. 8). As a result, the ventilation air blown from the indoor blower 52 is cooled and dehumidified. The refrigerant flowing out of the indoor evaporator 18 flows into the fifth three-way joint 12*e* via the second check valve 16*b*.

The refrigerant flowing out of the other of the outflow ports of the four-way joint 12*x* flows into the cooling expansion valve 14*c* and is decompressed (from the point bh8 to a point ch8 in FIG. 8), similarly in the hot gas heating mode. The refrigerant decompressed by the cooling expansion valve 14*c* flows into the other of the inflow ports of the sixth three-way joint 12*f*, similarly in the hot gas heating mode.

Here, in FIG. 8, the pressure of the refrigerant (the point ch8 in FIG. 8) decompressed by the cooling expansion valve 14*c* is set, for clarity of illustration, to a value higher than the pressure of the refrigerant (the point fh8 in FIG. 8) decompressed by the air conditioning expansion valve 14*b*, but the present disclosure is not limited thereto. The pressure of the refrigerant decompressed by the cooling expansion valve 14*c* may be lower than or equal to the pressure of the refrigerant decompressed by the air conditioning expansion valve 14*b*.

The other of the refrigerants branched at the first three-way joint 12*a* is adjusted in flow rate and decompressed (from the point ah8 to a point dh8 in FIG. 8) by the bypass side flow rate adjustment valve 14*d* disposed in the bypass passage 21*a*. The refrigerant decompressed by the bypass side flow rate adjustment valve 14*d* flows into the one of the inflow ports of the sixth three-way joint 12*f*, similarly in the hot gas heating mode.

The refrigerant flowing out of the bypass side flow rate adjustment valve 14*d* is mixed with the refrigerant flowing out of the cooling expansion valve 14*c* at the sixth three-way joint 12*f*, similarly in the hot gas heating mode. Furthermore, the refrigerant having flowed into the chiller 20 from the sixth three-way joint 12*f* is homogeneously mixed at the chiller 20 (a point eh8 in FIG. 8). The refrigerant flowing out of the chiller 20 flows into the fifth three-way joint 12*e*.

At the fifth three-way joint 12*e*, the flow of the refrigerant flowing out of the indoor evaporator 18 is merged with the flow of the refrigerant flowing out of the chiller 20. The refrigerant flowing out of the fifth three-way joint 12*e* flows into the accumulator 23. The gas-phase refrigerant separated in the accumulator 23 is sucked into the compressor 11 and compressed again.

In the high-temperature side heat medium circuit 30 in the single hot gas dehumidification heating mode, the high-temperature side heat medium heated by the water-refrigerant heat exchanger 13 is pumped to the heater core 32, similarly in the single air conditioning mode.

In the indoor air conditioning unit 50 in the single hot gas dehumidification heating mode, the ventilation air cooled and dehumidified by the indoor evaporator 18 is reheated by the heater core 32 and blown out into the vehicle interior. As a result, dehumidification heating of the vehicle interior is realized.

In the single hot gas dehumidification heating mode, the heat generated by the work of the compressor 11 can be effectively used to heat the ventilation air, similarly in the hot gas heating mode. Furthermore, in the single hot gas dehumidification heating mode, the heat absorbed from the ventilation air by the refrigerant in the indoor evaporator 18 can be used to reheat the ventilation air.

When the heating capability is below the target heating capability, the ventilation air temperature TAV can be brought closer to the target air temperature TAO by executing the high-pressure rise control, similarly in the hot gas heating mode.

(i-2) Cooling Hot Gas Dehumidification Heating Mode

In the heat pump cycle 10 in the cooling hot gas dehumidification heating mode, the refrigerant circulates similarly in the single hot gas dehumidification heating mode.

In the high-temperature side heat medium circuit 30 in the cooling hot gas dehumidification heating mode, the control device 60 controls the operation of the high-temperature side pump 31, similarly in the single air conditioning mode.

In the low-temperature side heat medium circuit 40 in the cooling hot gas dehumidification heating mode, the control device 60 stops the low-temperature side pump 41.

In the indoor air conditioning unit 50 in the cooling hot gas dehumidification heating mode, the control device 60 controls the air blowing capability of the indoor blower 52, the opening degree of the air mix door 54, and the operations of the inside/outside air switching device 53 and the blowout mode door, similarly in the single hot gas dehumidification heating mode. The control device 60 appropriately controls the operations of the other control target equipment, similarly in the single hot gas dehumidification heating mode.

Accordingly, in the heat pump cycle 10 in the cooling hot gas dehumidification heating mode, the water-refrigerant heat exchanger 13 is caused to function as a condenser and the indoor evaporator 18 is caused to function, similarly in the single hot gas dehumidification heating mode. Furthermore, the chiller 20 is caused to function as an evaporator.

In the high-temperature side heat medium circuit 30 in the cooling hot gas dehumidification heating mode, the high-temperature side heat medium heated by the water-refrigerant heat exchanger 13 is pumped to the heater core 32, similarly in the single air conditioning mode.

In the low-temperature side heat medium circuit 40 in the cooling hot gas dehumidification heating mode, the low-temperature side heat medium cooled by the chiller 20 flows through the cooling water passage 70*a* of the battery 70, whereby the battery 70 is cooled, similarly in the cooling air-conditioning mode.

In the cooling hot gas dehumidification heating mode, the heat generated by the work of the compressor 11 can be effectively used to heat the ventilation air, similarly in the single hot gas dehumidification heating mode. Furthermore, in the cooling hot gas dehumidification heating mode, the heat absorbed from the ventilation air by the refrigerant in the indoor evaporator 18 can be used to reheat the ventilation air.

When the heating capability is below the target heating capability, the ventilation air temperature TAV can be brought closer to the target air temperature TAO by executing the high-pressure rise control, similarly in the hot gas heating mode.

In the vehicle air conditioner 1 of the present embodiment, comfortable air conditioning of the vehicle interior and appropriate temperature adjustment of the battery 70 as the in-vehicle equipment, can be performed by switching the operation modes, as described above.

Here, in the hot gas heating mode, the temperature adjustment hot gas heating mode, and the hot gas dehumidification heating mode of the vehicle air conditioner 1 of the present embodiment, the ventilation air as the heating object, is heated mainly by using the heat generated by the work of the compressor 11. Therefore, in the hot gas heating mode and the like, the operations of the control target equipment must be appropriately controlled such that, in order to stabilize the operation of the cycle, the workload of the compressor 11 becomes an appropriate amount of heat for heating the ventilation air.

The reason for this is that, for example, if the workload of the compressor 11 is excessive with respect to the amount of heat required to heat the ventilation air, the discharged refrigerant pressure Pd continues to rise, and there is a possibility that the cycle cannot be stably operated.

Accordingly, in the hot gas heating mode and the like of the present embodiment, the control process in the hot gas mode is executed. In the control process in the hot gas mode, the rotation speed of the compressor 11 is controlled such that the sucked refrigerant pressure Ps approaches the target low pressure PSO.

Furthermore, the aperture opening of the bypass side flow rate adjustment valve 14*d* is adjusted such that the high-low pressure difference ΔP approaches the target high-low pressure difference ΔPO.

This allows the discharged refrigerant pressure Pd and the sucked refrigerant pressure Ps to be adjusted such that the workload of the compressor 11 becomes an appropriate amount of heat for heating the ventilation air. This is because the workload of the compressor 11 is determined by the high-low pressure difference ΔP. Accordingly, the operation of the cycle can be stabilized by executing the control process in the hot gas mode.

On the other hand, if the actual discharged refrigerant pressure Pd cannot be sufficiently raised, such as when the outside air temperature Tam is extremely low, even in an attempt to stabilize the operation of the cycle, the discharged refrigerant temperature Td cannot be raised to a desired temperature. As a result, there is a possibility that the ventilation air temperature TAV cannot be raised to the target air temperature TAO.

On the other hand, in the hot gas heating mode and the like of the present embodiment, the high-pressure rise control is executed when it is determined that the heating capability for the ventilation air of the vehicle air conditioner 1 is below the target heating capability. This allows the discharged refrigerant pressure Pd to be raised, whereby the discharged refrigerant temperature Td can be raised. Accordingly, the temperature adjustment range for the ventilation air can be expanded.

Under the high-pressure rise control of the vehicle air conditioner 1 of the present embodiment, the subcooling degree of the refrigerant flowing out of the refrigerant passage of the water-refrigerant heat exchanger 13 is made higher than under the normal control in the hot gas mode. This allows the heat exchange efficiency in the water-refrigerant heat exchanger 13 to be lowered, whereby the discharged refrigerant pressure Pd can be raised reliably.

Furthermore, in the present embodiment, the subcooling degree of the refrigerant flowing out of the refrigerant passage of the water-refrigerant heat exchanger 13 is raised by reducing the throttle opening degree of the cooling expansion valve 14*c*. Accordingly. the high-pressure rise control can be realized without requiring a new configuration or complicated control for executing the high-pressure rise control.

In the vehicle air conditioner 1 of the present embodiment, when the ventilation air temperature TAV is lower than the target air temperature TAO and the rotation speed of the compressor 11 is equal to or higher than the maximum rotation speed, it is determined that the heating capability is below the target heating capability.

This allows the ventilation air temperature TAV to be raised when the rotation speed of the compressor 11 cannot be increased, whereby the high-pressure rise control can be effectively executed.

In addition, in the vehicle air conditioner 1 of the present embodiment, it is determined that the heating capability is below the target heating capability when the ventilation air temperature TAV is lower than the target air temperature TAO and the throttle opening degree of the bypass side flow rate adjustment valve 14*d* is equal to or lower than the minimum opening degree. This allows the ventilation air temperature TAV to be raised when the throttle opening degree of the bypass side flow rate adjustment valve 14*d* cannot be reduced, whereby the high-pressure rise control can be effectively executed.

The control process in the hot gas mode may be applied to the parallel hot gas dehumidification heating mode and the outside air heat absorption hot gas heating mode. In the parallel hot gas dehumidification heating mode and the outside air heat absorption hot gas heating mode, frost is formed in the outdoor heat exchanger 15, and thus the refrigerant cannot absorb heat from the outside air in the outdoor heat exchanger 15. That is, the outdoor heat exchanger 15 becomes equivalent to the refrigerant passage.

Accordingly, when the control process in the hot gas mode is applied in the parallel dehumidification hot gas heating mode and the outside air heat absorption hot gas heating mode, the heating expansion valve 14*a* serves as the heating-unit side decompression unit, and the fifth three-way joint 12*e* serves as the mixing part.

Therefore, under the high-pressure rise control, the throttle opening degree of the heating expansion valve 14*a* may be made smaller than the throttle opening degree determined in the step S14.

Second Embodiment

In the present embodiment, an example, in which the control process under the high-pressure rise control described in the step S16 in FIG. 4 in the first embodiment is changed, will be described.

Under high-pressure rise control of the present embodiment, control is performed in which the flow rate of a heating object flowing into the heating unit is made smaller than under the normal control in the hot gas mode. More specifically, in a step S16 of the present embodiment, the opening degree of an air mix door 54 is changed to a side where the air volume of the ventilation air passing through a heater core 32 is reduced, from the opening degree determined in the step S14. The operations of the other control target equipment are similar to those of the first embodiment.

Figure 9:
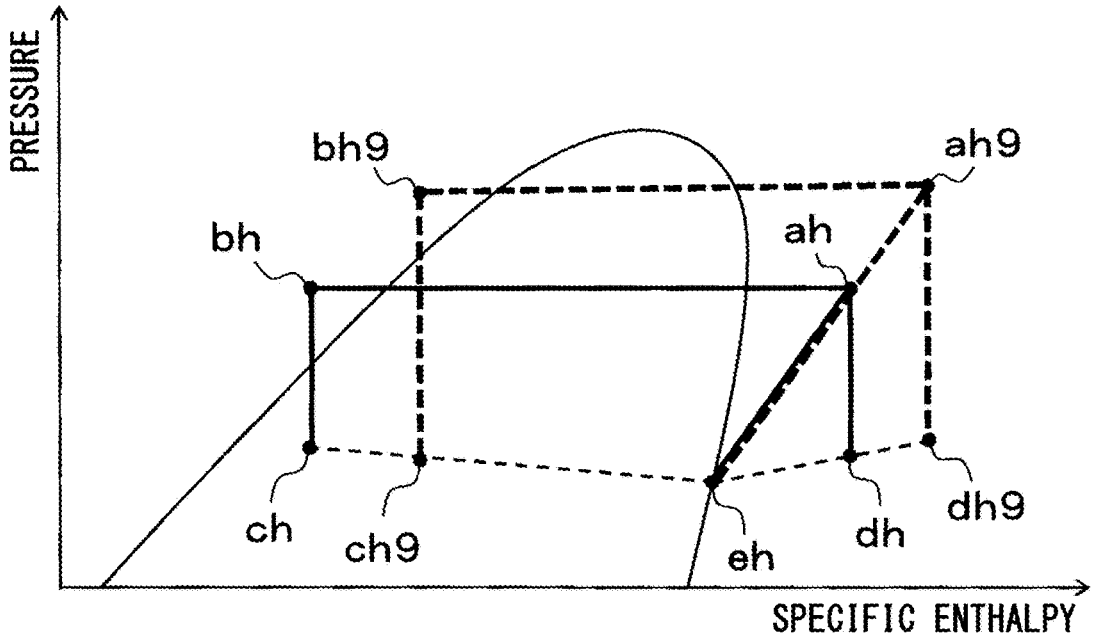
FIG. 9 is a Mollier diagram showing a change in a state of a refrigerant in a hot gas heating mode of a heat pump cycle according to a second embodiment.
Figure 10:
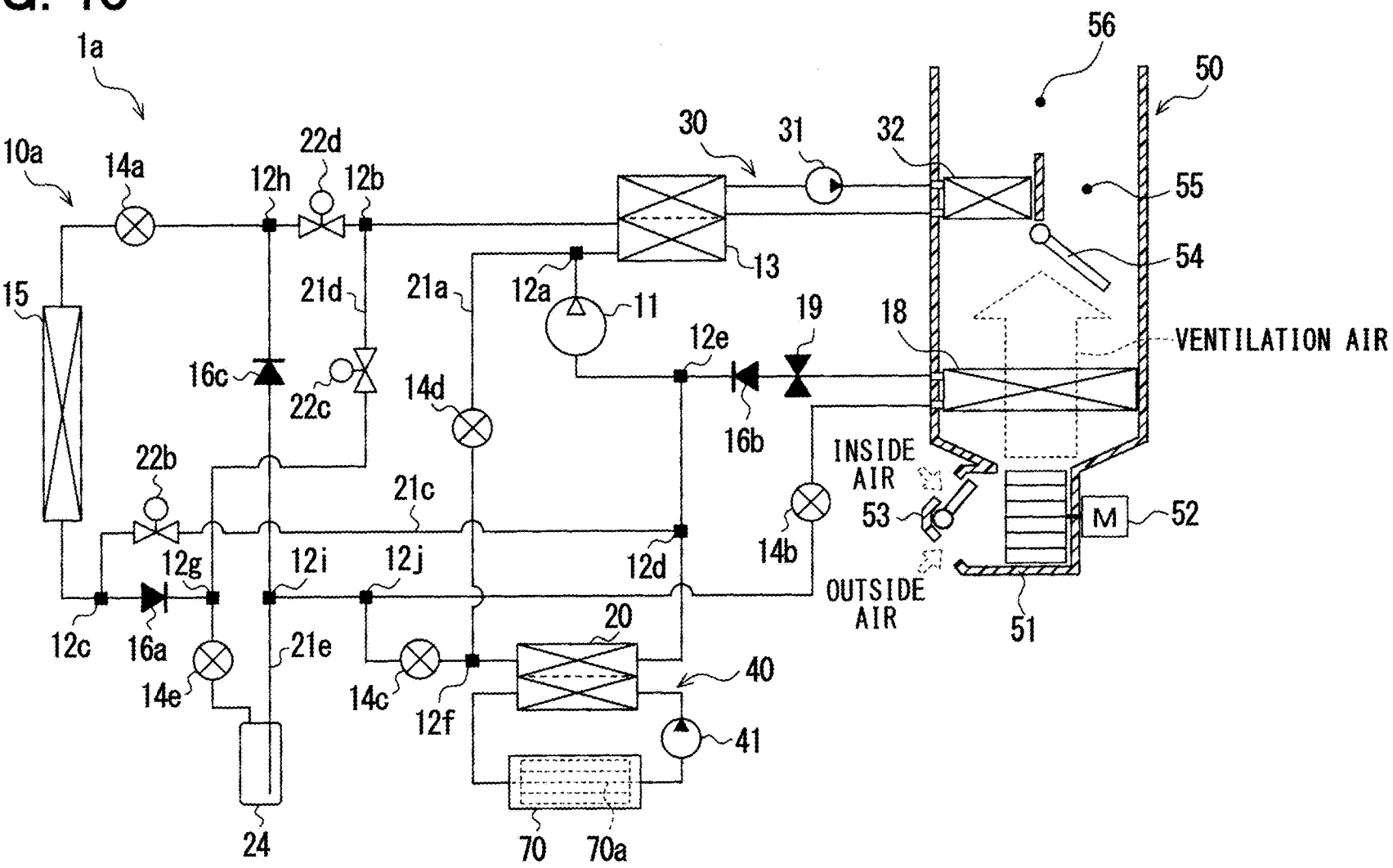
FIG. 10 is a schematic overall configuration diagram of a vehicle air conditioner according to a third embodiment.

Accordingly, in a heat pump cycle 10 in a hot gas heating mode of the present embodiment, the state of the refrigerant changes as indicated by the thick solid lines in the Mollier diagram in FIG. 9. That is, under the normal control in the hot gas mode, the state of the refrigerant changes just similarly in the first embodiment.

Under the high-pressure rise control of the present embodiment, the temperature of the high-temperature side heat medium flowing out of a heater core 32 and flowing into a water-refrigerant heat exchanger 13 is higher than under the normal control. Therefore, the load on the water-refrigerant heat exchanger 13 decreases, and the pressure of the refrigerant flowing through the refrigerant passage of the water-refrigerant heat exchanger 13 is balanced at a pressure higher than under the normal control (from a point ah9 to a point bh9 in FIG. 9), as indicated by the thick dashed line in the Mollier diagram in FIG. 9.

The refrigerant flowing out of the water-refrigerant heat exchanger 13 flows into a cooling expansion valve 14*c* and is decompressed (from a point ch9 to the point ch9 in FIG. 9). At this time, the throttle opening degree of the cooling expansion valve 14*c* is adjusted such that the subcooling degree of the refrigerant (the point ch9 in FIG. 9) flowing out of the water-refrigerant heat exchanger 13 approaches a first target subcooling degree SCO1, similarly under the normal control.

The other of the refrigerants branched at a first three-way joint 12*a* is adjusted in flow rate and decompressed (from the point ah9 to a point dh9 in FIG. 9) by a bypass side flow rate adjustment valve 14*d* in a bypass passage 21*a*. The refrigerant flowing out of the bypass side flow rate adjustment valve 14*d* is mixed with the refrigerant flowing out of the cooling expansion valve 14*c* at a sixth three-way joint 12*f*.

The other operations are similar to those of the first embodiment. Under the high-pressure rise control, the temperature of the high-temperature side heat medium can be made higher than under the normal control. As a result, the ventilation air temperature TAV can be brought closer to the target air temperature TAO by raising the temperature of the ventilation air to be heated by the heater core 32. Accordingly, even if the control process under the high-pressure rise control is changed as in the present embodiment, the same effects as in the first embodiment can be obtained.

Control, under which the flow rate of the heating object flowing into the heating unit is made smaller than under the normal control in the hot gas mode, as the high-pressure rise control of the present embodiment, is not limited to the adjustment of the opening degree of the air mix door 54. For example, the rotation speed (i.e., the air blowing capability) of the indoor blower 52 may be reduced.

Alternatively, in a configuration in which the high-temperature side heat medium is circulated in the high-temperature side heat medium circuit 30, as in the heating unit of the present embodiment, control, under which the flow rate of the high-temperature side heat medium is made smaller than under the normal control in the hot gas mode, may be adopted as the high-pressure rise control. Specifically, the flow rate of the high-temperature side heat medium may be reduced by making the rotation speed (i.e., the pumping capability) of the high-pressure side pump lower than under the normal control in the hot gas mode.

Furthermore, the high-pressure rise control to be executed may be changed depending on a request from a user. For example, when a user sets the air blowing volume of the indoor blower 52 with the air volume setting switch, control, under which the opening degree of the air mix door 54 is changed, may be executed as the high-pressure rise control. On the other hand, when a user does not set the air blowing volume of the indoor blower 52 with the air volume setting switch, control, under which the rotation speed of the indoor blower 52 is lowered, may be executed as the high-pressure rise control.

Third Embodiment

In the present embodiment, the heat pump cycle device according to the present disclosure is applied to a vehicle air conditioner 1*a*. The vehicle air conditioner 1*a* includes a heat pump cycle 10*a*. In the heat pump cycle 10*a*, the accumulator 23 and the like are eliminated from the heat pump cycle 10 described in the first embodiment, and a receiver 24 and the like are adopted.

In the heat pump cycle 10*a*, the inlet side of the receiver 24 is connected to the other of the outflow ports of a second three-way joint 12*b*. The refrigerant passage from the other of the outflow ports of the second three-way joint 12*b* to the inlet of the receiver 24 is an inlet side passage 21*d*. In the inlet side passage 21*d*, a first inlet side on-off valve 22*c*, a seventh three-way joint 12*g*, and a subcooling expansion valve 14*e* are disposed.

The receiver 24 is a high-pressure side gas-liquid separation part that separates the refrigerant having flowed into the receiver 24 into gas and liquid, and stores the separated liquid-phase refrigerant as a surplus refrigerant in the cycle. The receiver 24 causes a part of the separated liquid-phase refrigerant to flow out downstream from a liquid-phase refrigerant outlet.

The first inlet side on-off valve 22*c* is an on-off valve that opens and closes the inlet side passage 21*d*. More specifically, the first inlet side on-off valve 22*c* opens and closes, of the inlet side passage 21*d*, a refrigerant passage from the other of the outflow ports of the second three-way joint 12*b* to one of the inflow ports of the seventh three-way joint 12*g*. The first inlet side on-off valve 22*c* serves as the refrigerant circuit switching part.

The subcooling expansion valve 14*e* serves as a decompression unit on the receiver side that, under the high-pressure rise control in the hot gas heating mode and the like, decompresses the refrigerant flowing into the receiver 24. Furthermore, the subcooling expansion valve 14*e* serves as a flow rate adjustment part on the receiver side that adjusts the flow rate (mass flow rate) of the refrigerant flowing into the receiver 24.

One of the inflow port sides of an eighth three-way joint 12*h* is connected to one of the outflow ports of the second three-way joint 12*b*. A second inlet side on-off valve 22*d* is disposed in the refrigerant passage from the one of the outflow ports of the second three-way joint 12*b* to the one of the inflow ports of the eighth three-way joint 12*h*. The second inlet side on-off valve 22*d* opens and closes the refrigerant passage from the one of the outflow ports of the second three-way joint 12*b* to the one of the inflow ports of the eighth three-way joint 12*h*. The second inlet side on-off valve 22*d* serves as the refrigerant circuit switching part.

The inlet side of a heating expansion valve 14*a* is connected to the outflow port of the eighth three-way joint 12*h*. The other of the inlet sides of the seventh three-way joint 12*g* disposed in the inlet side passage 21*d* is connected, via a first check valve 16*a*, to one of the outflow ports of a third three-way joint 12*c* connected to the outlet side of an outdoor heat exchanger 15.

The other of the inflow port sides of the eighth three-way joint 12*h* is connected to the liquid-phase refrigerant outlet of the receiver 24. The refrigerant passage from the outlet of the receiver 24 to the other of the inflow ports of the eighth three-way joint 12*h* is an outlet side passage 21*e*. A ninth three-way joint 12*i* and a third check valve 16*c* are disposed in the outlet side passage 21*e*.

The third check valve 16*c* allows the refrigerant to flow from the ninth three-way joint 12*i* side to the eighth three-way joint 12*h* side, and prohibits the refrigerant from flowing from the eighth three-way joint 12*h* side to the ninth three-way joint 12*i* side.

The inflow port side of a tenth three-way joint 12*j* is connected to the other of the outflow ports of the ninth three-way joint 12*i*. The refrigerant inlet side of an indoor evaporator 18 is connected to one of the outflow ports of the tenth three-way joint 12*j* via an air conditioning expansion valve 14*b*. The inlet side of the refrigerant passage of a chiller 20 is connected to the other of the outflow ports of the tenth three-way joint 12*j* via a cooling expansion valve 14*c*.

Furthermore, in the heat pump cycle 10*a*, the suction port side of a compressor 11 is connected to the outflow port of a fifth three-way joint 12*e*. The other configurations of the vehicle air conditioner 1*a* are similar to those of the vehicle air conditioner 1 described in the first embodiment.

Next, the operation of the vehicle air conditioner 1*a*, having the above configurations, of the present embodiment will be described. In the vehicle air conditioner 1*a* of the present embodiment, various operation modes are switched to similarly in the first embodiment in order to perform air conditioning of the vehicle interior and temperature adjustment of the battery 70. Hereinafter, the detailed operation of each operation mode will be described.

(a-1) Single Air Conditioning Mode

In the heat pump cycle 10*a* in a single air conditioning mode, the control device 60 brings the heating expansion valve 14*a* into a fully opened state, brings the air conditioning expansion valve 14*b* into an aperture state, brings the cooling expansion valve 14*c* into a fully closed state, brings the bypass side flow rate adjustment valve 14*d* into a fully closed state, and brings the subcooling expansion valve 14*e* into a fully opened state. In addition, the control device 60 closes the heating on-off valve 22*b*, closes the first inlet side on-off valve 22*c*, and opens the second inlet side on-off valve 22*d*.

Therefore, in the heat pump cycle 10*a* in the single air conditioning mode, a refrigerant circuit is switched to in which the refrigerant discharged from the compressor 11 circulates through the water-refrigerant heat exchanger 13, the heating expansion valve 14*a* in the fully opened state, the outdoor heat exchanger 15, the subcooling expansion valve 14*e* in the fully opened state, the receiver 24, the air conditioning expansion valve 14*b* in the aperture state, the indoor evaporator 18, and the suction port of the compressor 11 in this order.

Furthermore, the control device 60 appropriately controls the operations of the other control target equipment, similarly in the single air conditioning mode of the first embodiment.

Accordingly, in the heat pump cycle 10*a* in the single air conditioning mode, a vapor compression refrigeration cycle is configured in which the water-refrigerant heat exchanger 13 and the outdoor heat exchanger 15 are caused to function as condensers and the indoor evaporator 18 is caused to function as an evaporator. In the high-temperature side heat medium circuit 30 and the indoor air conditioning unit 50, the same operations as in the single air conditioning mode of the first embodiment are performed.

As a result, in the single air conditioning mode, air conditioning of the vehicle interior is realized similarly in the single air conditioning mode of the first embodiment.

(a-2) Cooling Air-Conditioning Mode

In the heat pump cycle 10*a* in a cooling air-conditioning mode, the control device 60 brings the cooling expansion valve 14*c* into an aperture state, contrary to the single air conditioning mode.

Therefore, in the heat pump cycle 10*a* in the cooling air-conditioning mode, the refrigerant discharged from the compressor 11 circulates similarly in the single air conditioning mode. At the same time, a refrigerant circuit is switched to in which the refrigerant discharged from the compressor 11 circulates through the water-refrigerant heat exchanger 13, the heating expansion valve 14*a* in the fully opened state, the outdoor heat exchanger 15, the subcooling expansion valve 14*e* in the fully opened state, the receiver 24, the cooling expansion valve 14*c* in the aperture state, the chiller 20, and the suction port of the compressor 11 in this order. That is, a refrigerant circuit is switched to in which the indoor evaporator 18 and the chiller 20 are connected in parallel for the flow of the refrigerant.

Further, the control device 60 appropriately controls the operations of the other control target equipment, similarly in the cooling air-conditioning mode of the first embodiment.

Accordingly, in the heat pump cycle 10*a* in the cooling air-conditioning mode, a vapor compression refrigeration cycle is configured in which the water-refrigerant heat exchanger 13 and the outdoor heat exchanger 15 are caused to function as condensers and the indoor evaporator 18 and the chiller 20 are caused to function as evaporators. In the high-temperature side heat medium circuit 30, the low-temperature side heat medium circuit 40, and the indoor air conditioning unit 50, the same operations as in the single air conditioning mode of the first embodiment are performed.

As a result, in the cooling air-conditioning mode, cooling of the battery 70 and air conditioning of the vehicle interior are realized similarly in the cooling air-conditioning mode of the first embodiment.

(b-1) Single Series Dehumidification Heating Mode

In the heat pump cycle 10*a* in a single series dehumidification heating mode, the control device 60 brings the heating expansion valve 14*a* into an aperture state, brings the air conditioning expansion valve 14*b* into an aperture state, brings the cooling expansion valve 14*c* into a fully closed state, brings the bypass side flow rate adjustment valve 14*d* into a fully closed state, and brings the subcooling expansion valve 14*e* into a fully opened state. In addition, the control device 60 closes the heating on-off valve 22*b*, closes the first inlet side on-off valve 22*c*, and opens the second inlet side on-off valve 22*d*.

Therefore, in the heat pump cycle 10*a* in the single series dehumidification heating mode, a refrigerant circuit is switched to in which the refrigerant discharged from the compressor 11 circulates through the water-refrigerant heat exchanger 13, the heating expansion valve 14*a* in the aperture state, the outdoor heat exchanger 15, the subcooling expansion valve 14*e* in the fully opened state, the receiver 24, the air conditioning expansion valve 14*b* in the aperture state, the indoor evaporator 18, and the suction port of the compressor 11 in this order.

Furthermore, the control device 60 appropriately controls the operations of the other control target equipment, similarly in the single series dehumidification heating mode of the first embodiment.

Accordingly, in the heat pump cycle 10*a* in the single series dehumidification heating mode, a vapor compression refrigeration cycle is configured in which the water-refrigerant heat exchanger 13 and the outdoor heat exchanger 15 are caused to function as condensers and the indoor evaporator 18 is caused to functions as an evaporator. The high-temperature side heat medium circuit 30 and the indoor air conditioning unit 50 operate similarly in the single air conditioning mode of the first embodiment.

As a result, in the single series dehumidification heating mode, dehumidification heating of the vehicle interior is realized similarly in the single series dehumidification heating mode of the first embodiment.

Here, the heat pump cycle 10*a* includes the receiver 24, and thus it is configured such that the single series dehumidification heating mode and a cooling series dehumidification heating mode are executed within a temperature range in which the saturation temperature of the refrigerant in the outdoor heat exchanger 15 is higher than the outside air temperature Tam.

(b-2) Cooling Series Dehumidification Heating Mode

In the heat pump cycle 10*a* in the cooling series dehumidification heating mode, the control device 60 brings the cooling expansion valve 14*c* into an aperture state, contrary to the single series dehumidification heating mode.

Therefore, in the heat pump cycle 10*a* in the cooling series dehumidification heating mode, the refrigerant discharged from the compressor 11 circulates similarly in the single series dehumidification heating mode. At the same time, a refrigerant circuit is switched to in which the refrigerant discharged from the compressor 11 circulates through the water-refrigerant heat exchanger 13, the heating expansion valve 14*a* in the fully opened state, the outdoor heat exchanger 15, the subcooling expansion valve 14*e* in the fully opened state, the receiver 24, the cooling expansion valve 14*c* in the aperture state, the chiller 20, and the suction port of the compressor 11 in this order. That is, a refrigerant circuit is switched to in which the indoor evaporator 18 and the chiller 20 are connected in parallel for the flow of the refrigerant.

Furthermore, the control device 60 appropriately controls the operations of the other control target equipment, similarly in the cooling series dehumidification heating mode of the first embodiment.

Accordingly, in the heat pump cycle 10*a* in the cooling series dehumidification heating mode, a vapor compression refrigeration cycle is configured in which the water-refrigerant heat exchanger 13 and the outdoor heat exchanger 15 are caused to function as condensers and the indoor evaporator 18 and the chiller 20 are caused to function as evaporators. In the high-temperature side heat medium circuit 30, the low-temperature side heat medium circuit 40, and the indoor air conditioning unit 50, the same operations as in the cooling series dehumidification heating mode of the first embodiment are performed.

As a result, in the cooling series dehumidification heating mode, cooling of the battery 70 and dehumidification heating of the vehicle interior are realized similarly in the cooling series dehumidification heating mode of the first embodiment.

(c-1) Single Parallel Dehumidification Heating Mode

In the heat pump cycle 10*a* in a single parallel dehumidification heating mode, the control device 60 brings the heating expansion valve 14*a* into an aperture state, brings the air conditioning expansion valve 14*b* into an aperture state, brings the cooling expansion valve 14*c* into a fully closed state, brings the bypass side flow rate adjustment valve 14*d* into a fully closed state, and brings the subcooling expansion valve 14*e* into a fully opened state. In addition, the control device 60 opens the heating on-off valve 22*b*, opens the first inlet side on-off valve 22*c*, and closes the second inlet side on-off valve 22*d*.

Therefore, in the heat pump cycle 10*a* in the single parallel dehumidification heating mode, the refrigerant discharged from the compressor 11 circulates through the water-refrigerant heat exchanger 13, the subcooling expansion valve 14*e* in the fully opened state, the receiver 24, the heating expansion valve 14*a* in the aperture state, the outdoor heat exchanger 15, the heating passage 21*c*, and the suction port of the compressor 11 in this order. At the same time, a refrigerant circuit is switched to in which the refrigerant discharged from the compressor 11 circulates through the water-refrigerant heat exchanger 13, the subcooling expansion valve 14*e* in the fully opened state, the receiver 24, the air conditioning expansion valve 14*b* in the aperture state, the indoor evaporator 18, and the suction port of the compressor 11 in this order. That is, a refrigerant circuit is switched to in which the outdoor heat exchanger 15 and the indoor evaporator 18 are connected in parallel for the flow of the refrigerant.

Furthermore, the control device 60 appropriately controls the operations of the other control target equipment, similarly in the single parallel dehumidification heating mode of the first embodiment.

Accordingly, in the heat pump cycle 10*a* in the single parallel dehumidification heating mode, a vapor compression refrigeration cycle is configured in which the water-refrigerant heat exchanger 13 is caused to function as a condenser and the indoor evaporator 18 and the outdoor heat exchanger 15 are caused to function as evaporators. In the high-temperature side heat medium circuit 30 and the indoor air conditioning unit 50, the same operations as in the single parallel dehumidification heating mode of the first embodiment are performed.

As a result, in the single parallel dehumidification heating mode, dehumidification heating of the vehicle interior is realized similarly in the single parallel dehumidification heating mode of the first embodiment.

(c-2) Cooling Parallel Dehumidification Heating Mode

In the heat pump cycle 10*a* in a cooling parallel dehumidification beating mode, the control device 60 brings the cooling expansion valve 14*c* into an aperture state, contrary to the single parallel dehumidification heating mode.

Therefore, in the heat pump cycle 10*a* in the cooling parallel dehumidification heating mode, the refrigerant discharged from the compressor 11 circulates similarly in the single parallel dehumidification heating mode. At the same time, a refrigerant circuit is switched to in which the refrigerant discharged from the compressor 11 circulates through the water-refrigerant heat exchanger 13, the subcooling expansion valve 14*e* in the fully opened state, the receiver 24, the cooling expansion valve 14*c* in the aperture state, the chiller 20, and the suction port of compressor 11 in this order. That is, a refrigerant circuit is switched to in which the outdoor heat exchanger 15, the indoor evaporator 18, and the chiller 20 are connected in parallel for the flow of the refrigerant.

Furthermore, the control device 60 appropriately controls the operations of the other control target equipment, similarly in the cooling parallel dehumidification heating mode of the first embodiment.

Accordingly, in the heat pump cycle 10*a* in the cooling parallel dehumidification heating mode, a vapor compression refrigeration cycle is configured in which the water-refrigerant heat exchanger 13 is caused to function as a condenser and the outdoor heat exchanger 15, the indoor evaporator 18, and the chiller 20 are caused to function as evaporators. In the high-temperature side heat medium circuit 30, the low-temperature side heat medium circuit 40, and the indoor air conditioning unit 50, the same operations as in the cooling parallel dehumidification heating mode of the first embodiment are performed.

As a result, in the cooling parallel dehumidification heating mode, cooling of the battery 70 and dehumidification heating of the vehicle interior are realized similarly in the cooling parallel dehumidification heating mode of the first embodiment.

(d-1) Single Parallel Hot Gas Dehumidification Heating Mode

In the heat pump cycle 10*a* in a single parallel hot gas dehumidification heating mode, the control device 60 brings the bypass side flow rate adjustment valve 14*d* into an aperture state, and brings the cooling expansion valve 14*c* into an aperture state, contrary to the single parallel dehumidification heating mode.

Therefore, in the heat pump cycle 10*a* in the single parallel hot gas dehumidification heating mode, the refrigerant discharged from the compressor 11 circulates similarly in the cooling parallel dehumidification heating mode. At the same time, a refrigerant circuit is switched to in which a part of the refrigerant discharged from the compressor 11 circulates through the bypass side flow rate adjustment valve 14*d* in the aperture state, the chiller 20, and the suction port of the compressor 11 in this order.

Furthermore, the control device 60 appropriately controls the operations of the other control target equipment, similarly in the single parallel hot gas dehumidification heating mode of the first embodiment.

Accordingly, in the parallel hot gas dehumidification heating mode, a decrease in the heating capability for the ventilation air can be suppressed even if frost is formed in the outdoor heat exchanger 15 during the execution of the single parallel dehumidification heating mode, similarly in the first embodiment.

(d-2) Cooling Parallel Hot Gas Dehumidification Heating Mode

In the heat pump cycle 10*a* in a cooling parallel hot gas dehumidification heating mode, the refrigerant circulates similarly in the single parallel hot gas dehumidification heating mode.

Furthermore, the control device 60 appropriately controls the operations of the other control target equipment, similarly in the cooling parallel hot gas dehumidification heating mode of the first embodiment.

Accordingly, in the cooling parallel hot gas dehumidification heating mode, a decrease in the heating capability for the ventilation air can be suppressed even if frost is formed in the outdoor heat exchanger 15 during the execution of the cooling parallel dehumidification heating mode, similarly in the first embodiment.

(e-1) Single Outside Air Heat Absorption Heating Mode

In the heat pump cycle 10*a* in a single outside air heat absorption heating mode, the control device 60 brings the heating expansion valve 14*a* into an aperture state, brings the air conditioning expansion valve 14*b* into a fully closed state, brings the cooling expansion valve 14*c* into a fully closed state, brings the bypass side flow rate adjustment valve 14*d* into a fully closed state, and brings the subcooling expansion valve 14*e* into a fully opened state. In addition, the control device 60 opens the heating on-off valve 22*b*, opens the first inlet side on-off valve 22*c*, and closes the second inlet side on-off valve 22*d*.

Therefore, in the heat pump cycle 10*a* in the single outside air heat absorption heating mode, a refrigerant circuit is switched to in which the refrigerant discharged from the compressor 11 circulates through the water-refrigerant heat exchanger 13, the subcooling expansion valve 14*e* in the fully opened state, the receiver 24, the heating expansion valve 14*a* in the aperture state, the outdoor heat exchanger 15, the heating passage 21*c*, and the suction port of the compressor 11 in this order.

Furthermore, the control device 60 appropriately controls the operations of the other control target equipment, similarly in the single outside air heat absorption heating mode of the first embodiment.

Accordingly, in the heat pump cycle 10*a* in the single outside air heat absorption heating mode, a vapor compression refrigeration cycle is configured in which the water-refrigerant heat exchanger 13 is caused to function as a condenser and the outdoor heat exchanger 15 is caused to function as an evaporator. In the high-temperature side heat medium circuit 30 and the indoor air conditioning unit 50, the same operations as in the single outside air heat absorption heating mode of the first embodiment are performed.

As a result, in the single outside air heat absorption heating mode, heating of the vehicle interior is realized similarly in the single outside air heat absorption heating mode of the first embodiment.

(e-2) Cooling Outside Air Heat Absorption Heating Mode

In the heat pump cycle 10*a* in a cooling outside air heat absorption heating mode, the control device 60 brings the cooling expansion valve 14*c* into an aperture state, contrary to the single outside air heat absorption heating mode.

Therefore, in the heat pump cycle 10*a* in the cooling outside air heat absorption heating mode, the refrigerant discharged from the compressor 11 circulates similarly in the single outside air heat absorption heating mode. At the same time, a refrigerant circuit is switched to in which the refrigerant discharged from the compressor 11 circulates through the water-refrigerant heat exchanger 13, the subcooling expansion valve 14*e* in the fully opened state, the receiver 24, the cooling expansion valve 14*c* in the aperture state, the chiller 20, and the suction port of compressor 11 in this order. That is, a refrigerant circuit is switched to in which the outdoor heat exchanger 15 and the chiller 20 are connected in parallel for the flow of the refrigerant.

Furthermore, the control device 60 appropriately controls the operations of the other control target equipment, similarly in the cooling outside air heat absorption heating mode of the first embodiment.

Accordingly, in the heat pump cycle 10*a* in the cooling outside air heat absorption heating mode, a vapor compression refrigeration cycle is configured in which the water-refrigerant heat exchanger 13 is caused to function as a condenser and the outdoor heat exchanger 15 and the chiller 20 are caused to function as evaporators. In the high-temperature side heat medium circuit 30, the low-temperature side heat medium circuit 40, and the indoor air conditioning unit 50, the same operations as in the cooling outside air heat absorption heating mode of the first embodiment are performed.

As a result, in the cooling outside air heat absorption heating mode, cooling of the battery 70 and heating of the vehicle interior are realized similarly in the cooling outside air heat absorption heating mode of the first embodiment.

(f-1) Single Outside Air Heat Absorption Hot Gas Heating Mode

In the heat pump cycle 10*a* in a single outside air heat absorption hot gas heating mode, the control device 60 brings the bypass side flow rate adjustment valve 14*d* into an aperture state and brings the cooling expansion valve 14*c* into an aperture state, contrary to the single outside air heat absorption heating mode.

Therefore, in the heat pump cycle 10*a* in the single outside air heat absorption hot gas heating mode, the refrigerant circulates similarly in the cooling outside air heat absorption heating mode. At the same time, a refrigerant circuit is switched to in which a part of the refrigerant discharged from the compressor 11 circulates through the bypass side flow rate adjustment valve 14*d* in the aperture state, the chiller 20, and the suction port of the compressor 11 in this order.

Furthermore, the control device 60 appropriately controls the operations of the other control target equipment, similarly in the single outside air heat absorption hot gas heating mode of the first embodiment.

Accordingly, in the single outside air heat absorption hot gas heating mode, a decrease in the heating capability for the ventilation air can be suppressed even if frost is formed in the outdoor heat exchanger 15 during the execution of the single outside air heat absorption heating mode, similarly in the first embodiment.

(f-2) Cooling Outside Air Heat Absorption Hot Gas Heating Mode

In the heat pump cycle 10*a* in a cooling outside air heat absorption hot gas heating mode, the refrigerant circulates similarly in the single outside air heat absorption hot gas heating mode.

Furthermore, the control device 60 appropriately controls the operations of the other control target equipment, similarly in the cooling outside air heat absorption hot gas heating mode of the first embodiment.

Accordingly, in the cooling outside air heat absorption hot gas heating mode, a decrease in the heating capability for the ventilation air can be suppressed even if frost is formed in the outdoor heat exchanger 15 during the execution of the cooling outside air heat absorption heating mode, similarly in the first embodiment.

(g) Hot Gas Heating Mode

A hot gas heating mode is included in the hot gas mode. Accordingly, in the hot gas heating mode, the control process in the hot gas mode of the first embodiment described with reference to the flowchart of FIG. 4 is executed.

Under the normal control in the hot gas heating mode, the control device 60 brings the heating expansion valve 14*a* into a fully closed state, brings the air conditioning expansion valve 14*b* into a fully closed state, brings the cooling expansion valve 14*c* into an aperture state, brings the bypass side flow rate adjustment valve 14*d* into an aperture state, and brings the subcooling expansion valve 14*e* into a fully opened state. In addition, the control device 60 closes the heating on-off valve 22*b*, opens the first inlet side on-off valve 22*c*, and closes the second inlet side on-off valve 22*d*.

Therefore, in the heat pump cycle 10*a* in the hot gas heating mode, the refrigerant discharged from the compressor 11 circulates through the first three-way joint 12*a*, the water-refrigerant heat exchanger 13, the subcooling expansion valve 14*e* in the fully opened state, the receiver 24, the cooling expansion valve 14*c* in the aperture state, the sixth three-way joint 12*f*, the chiller 20, and the suction port of the compressor 11 in this order. At the same time, a refrigerant circuit is switched to in which the refrigerant discharged from the compressor 11 circulates through the first three-way joint 12*a*, the bypass side flow rate adjustment valve 14*d* in the aperture state disposed in the bypass passage 21*a*, the sixth three-way joint 12*f*, the chiller 20, and the suction port of the compressor 11 in this order.

Accordingly, in the hot gas heating mode of the present embodiment, the subcooling expansion valve 14*e* and the cooling expansion valve 14*c* serve as the heating-unit side decompression units, and the sixth three-way joint 12*f* serves as the mixing part.

Furthermore, the control device 60 appropriately controls the operations of the other control target equipment, similarly in the hot gas heating mode of the first embodiment.

Accordingly, under the normal control in the hot gas heating mode, the heat generated by the work of the compressor 11 can be effectively used to heat the ventilation air, whereby the vehicle interior can be heated, similarly in the hot gas heating mode of the first embodiment.

Under the high-pressure rise control in the hot gas heating mode, the subcooling degree of the refrigerant flowing out of the refrigerant passage of the water-refrigerant heat exchanger 13 is raised by reducing the throttle opening degree of the subcooling expansion valve 14*e*. The other operations are similar to those under the normal control.

Accordingly, under the high-pressure rise control, the temperature of the high-temperature side heat medium can be made higher than under the normal control, similarly in the first embodiment. As a result, the ventilation air temperature TAV can be brought closer to the target air temperature TAO by raising the temperature of the ventilation air to be heated by the heater core 32.

(h-1) Cooling Hot Gas Heating Mode

A cooling hot gas heating mode is included in the hot gas mode. Accordingly, in the cooling hot gas heating mode, the control process in the hot gas mode is executed.

Under the normal control in the cooling hot gas heating mode, the control device 60 operates the low-temperature side pump 41 so as to exhibit predetermined reference pumping capability, contrary to the hot gas heating mode. The other operations are similar to those in the hot gas heating mode.

Accordingly, in the cooling hot gas heating mode, the heat generated by the work of the compressor 11 can be effectively used to heat the ventilation air. When the heating capability is below the target heating capability, the high-pressure rise control is executed, whereby the ventilation air temperature TAV can be brought close to the target air temperature TAO. Furthermore, the battery 70 can be cooled similarly in the cooling hot gas heating mode of the first embodiment.

(h-2) Warm-Up Hot Gas Heating Mode

A warm-up hot gas heating mode is included in the hot gas mode. Accordingly, in the warm-up hot gas heating mode, the control process in the hot gas mode is executed.

Under the normal control in the warm-up hot gas heating mode, the control device 60 operates the low-temperature side pump 41 so as to exhibit predetermined reference pumping capability, contrary to the hot gas heating mode. The other operations are similar to those in the hot gas heating mode.

Accordingly, in the warm-up hot gas heating mode, the heat generated by the work of the compressor 11 can be effectively used to heat the ventilation air. When the heating capability is below the target heating capability, the high-pressure rise control is executed, whereby the ventilation air temperature TAV can be brought close to the target air temperature TAO. Furthermore, the battery 70 can be warmed up similarly in the warm-up hot gas heating mode of the first embodiment.

(i-1) Single Hot Gas Dehumidification Heating Mode

A single hot gas dehumidification heating mode is included in the hot gas mode. Accordingly, in the single hot gas dehumidification heating mode, the control process in the hot gas mode is executed.

Under the normal control in the single hot gas dehumidification heating mode, the control device 60 brings the heating expansion valve 14*a* into a fully closed state, brings the air conditioning expansion valve 14*b* into an aperture state, brings the cooling expansion valve 14*c* into an aperture state, brings the bypass side flow rate adjustment valve 14*d* into an aperture state, and brings the subcooling expansion valve 14*e* into a fully opened state. In addition, the control device 60 closes the heating on-off valve 22*b*, opens the first inlet side on-off valve 22*c*, and closes the second inlet side on-off valve 22*d*.

Therefore, in the heat pump cycle 10*a* in the single hot gas dehumidification heating mode, the refrigerant discharged from the compressor 11 circulates similarly in the hot gas heating mode. At the same time, a refrigerant circuit is switched to in which the refrigerant discharged from the compressor 11 circulates through the first three-way joint 12*a*, the water-refrigerant heat exchanger 13, the subcooling expansion valve 14*e* in the fully opened state, the receiver 24, the air conditioning expansion valve 14*b* in the aperture state, the indoor evaporator 18, and the suction port of compressor 11 in this order.

Accordingly, in the single hot gas dehumidification heating mode, the subcooling expansion valve 14*e* and the cooling expansion valve 14*c* serve as the heating-unit side decompression units, and the sixth three-way joint 12*f* serves as the mixing part.

Furthermore, the control device 60 appropriately controls the operations of the other control target equipment, similarly in the single hot gas dehumidification heating mode of the first embodiment.

Accordingly, under the normal control in the single hot gas dehumidification heating mode, dehumidification heating of the vehicle interior can be performed by effectively using the heat generated by the work of the compressor 11 to heat the ventilation air, similarly in the hot gas dehumidification heating mode of the first embodiment. Furthermore, in the single hot gas dehumidification heating mode, the heat absorbed from the ventilation air by the refrigerant in the indoor evaporator 18 can be used to reheat the ventilation air.

Under the high-pressure rise control in the single hot gas dehumidification heating mode, the subcooling degree of the refrigerant flowing out of the refrigerant passage of the water-refrigerant heat exchanger 13 is raised by reducing the throttle opening degree of the subcooling expansion valve 14*e* that is the heating-unit side decompression unit. The other operations are similar to those under the normal control.

Accordingly, under the high-pressure rise control, the temperature of the high-temperature side heat medium can be made higher than under the normal control, similarly in the hot gas heating mode. As a result, the ventilation air temperature TAV can be brought closer to the target air temperature TAO by raising the temperature of the ventilation air to be heated by the heater core 32.

(i-2) Cooling Hot Gas Dehumidification Heating Mode

In the heat pump cycle 10*a* in a cooling hot gas dehumidification heating mode, the refrigerant circulates similarly in the single hot gas dehumidification heating mode.

Furthermore, the control device 60 appropriately controls the operations of the other control target equipment, similarly in the cooling parallel hot gas dehumidification heating mode of the first embodiment.

Accordingly, in the cooling hot gas dehumidification heating mode, the heat generated by the work of the compressor 11 can be effectively used to heat the ventilation air, similarly in the single hot gas dehumidification heating mode.

Furthermore, in the cooling hot gas dehumidification heating mode, the heat absorbed from the ventilation air by the refrigerant in the indoor evaporator 18 can be used to reheat the ventilation air.

When the heating capability is below the target heating capability, the ventilation air temperature TAV can be brought close to the target air temperature TAO by executing the high-pressure rise control, similarly in the single hot gas heating mode.

In the vehicle air conditioner 1*a* of the present embodiment, comfortable air conditioning of the vehicle interior and appropriate temperature adjustment of the battery 70, which is the in-vehicle equipment, can be performed by switching the operation modes, as described above.

Furthermore, the heat pump cycle 10*a* of the present embodiment includes the receiver 24, and thus the liquid-phase refrigerant on the high-pressure side can be stored in the receiver 24 as a surplus refrigerant in the cycle.

This allows the refrigerant on the outlet side of a heat exchange unit functioning as an evaporator to have a superheating degree in the air conditioning mode, the series dehumidification heating mode, the parallel dehumidification heating mode, the outside air heat absorption heating mode, and the like. Accordingly, an enthalpy difference, obtained by subtracting the enthalpy of the inlet side refrigerant from the enthalpy of the outlet side refrigerant in the heat exchange unit functioning as an evaporator, can be increased. As a result, in the heat pump cycle 10*a*, the amount of absorbed heat of the refrigerant in the heat exchange unit functioning as an evaporator can be increased, whereby the COP can be improved.

In the hot gas heating mode, the temperature adjustment hot gas heating mode, the hot gas dehumidification heating mode, and the like, the sucked refrigerant sucked into the compressor 11 can be brought close to the saturated gas-phase refrigerant. Accordingly, the refrigerant, having a higher density than that of the refrigerant having a superheating degree, can be sucked into the compressor 11. As a result, the discharge flow rate Gr of the compressor 11 at the same rotation speed can be stabilized and increased.

On the other hand, in a general heat pump cycle including the receiver, a refrigerant flowing out of a heat exchange unit functioning as a condenser becomes the saturated liquid-phase refrigerant, and thus it is difficult to impart a subcooling degree to the refrigerant flowing out of the heat exchange unit functioning as a condenser. In other words, in the heat pump cycle including the receiver, it is difficult to impart a subcooling degree to the refrigerant flowing out of the heating unit.

On the other hand, the heat pump cycle 10*a* of the present embodiment includes, as the heating-unit side decompression unit, the subcooling expansion valve 14*e* disposed on the upstream side, in the refrigerant flow, of the receiver 24 and a cooling side expansion valve 14*c* disposed on the downstream side, in the refrigerant flow, of the receiver 24. Under the high-pressure rise control, the throttle opening degree of the subcooling expansion valve 14*e* is reduced.

This allows the refrigerant flowing out of the heating unit to have a subcooling degree by executing the high-pressure rise control, even when the heat pump cycle 10*a* includes the receiver 24. Accordingly, even the vehicle air conditioner 1*a* of the present embodiment can expand the temperature adjustment range for the ventilation air by raising the discharged refrigerant pressure Pd, similarly in the first embodiment.

Also in the vehicle air conditioner 1*a* of the present embodiment, the control process in the hot gas mode may be applied to the parallel hot gas dehumidification heating mode and the outside air heat absorption hot gas heating mode. Even in the present embodiment, frost is formed in the outdoor heat exchanger 15 In the parallel hot gas dehumidification heating mode and the outside air heat absorption hot gas heating mode, and thus the refrigerant cannot absorb heat from the outside air in the outdoor heat exchanger 15. That is, the outdoor heat exchanger 15 becomes equivalent to the refrigerant passage.

Accordingly, when the control process in the hot gas mode is applied in the parallel dehumidification hot gas heating mode and the outside air heat absorption hot gas heating mode, the subcooling expansion valve 14*e* and the heating expansion valve 14*a* serve as the heating-unit side decompression units, and the fifth three-way joint 12*e* serves as the mixing part. Therefore, under the high-pressure rise control, the throttle opening degree of the subcooling expansion valve 14*e* may be reduced.

Alternatively, the high-pressure rise control described in the second embodiment may be applied to the vehicle air conditioner 1*a* of the present embodiment. Furthermore, when the high-pressure rise control described in the second embodiment is applied as the high-pressure rise control, the subcooling expansion valve 14*e* may be eliminated.

The present disclosure is not limited to the above embodiments, and can be variously modified as follows without departing from the gist of the present disclosure.

In the above embodiments, an example, in which the heat pump cycle device according to the present disclosure is applied to the air conditioner, has been described, but the application targets of the heat pump cycle device are not limited to air conditioners. For example, the heat pump cycle device may be applied to water heaters that heat domestic water or the like as the heating object.

The heating object is not limited to fluids. The heating object may be, for example, heat generating equipment in which a heat medium passage, that causes a high-temperature side heat medium to flow through, is formed for warming up or the like. In this case, control for making the flow rate of the high-temperature side heat medium smaller than under the normal control may be adopted as the high-pressure rise control.

The configuration of the heat pump cycle device according to the present disclosure is not limited to the configurations disclosed in the above embodiments.

In the first embodiment described above, an example, in which the heating unit is formed by each of the components that are the water-refrigerant heat exchanger 13 and the high-temperature side heat medium circuit 30, has been described, but the present disclosure is not limited thereto. For example, an indoor condenser may be adopted as the heating unit. The indoor condenser is a heat exchange unit for heating that heats the ventilation air by exchanging heat between the one of the discharged refrigerants branched at the first three-way joint 12*a* and the ventilation air having passed through the indoor evaporator 18. The indoor condenser may be disposed in the air passage of the indoor air conditioning unit 50, similarly to the heater core 32.

In the above embodiments, an example, in which the sixth three-way joint 12*f* as the mixing part is disposed on the upstream side, in the refrigerant flow, of the chiller 20, has been described. However, the sixth three-way joint 12*f* may be disposed on the downstream side, in the refrigerant flow, of the chiller 20. In this case, the refrigerant flowing out of the bypass side flow rate adjustment valve 14*d* and the refrigerant flowing out of the refrigerant passage of the chiller 20 are homogeneously mixed when flowing through the refrigerant pipe from the accumulator 23 and the sixth three-way joint 12*f* to the suction side of the compressor 11.

In the above embodiments, an operation example, in which the refrigerant having flowed through the bypass passage 21*a* is mixed with the refrigerant decompressed by the cooling expansion valve 14*c*, has been described, but the present disclosure is not limited thereto. For example, in (d-1) the single parallel hot gas dehumidification heating mode, an operation, in which the refrigerant having flowed through the bypass passage 21*a* is mixed with the refrigerant decompressed by the air conditioning expansion valve 14*b*, may be performed and the cooling expansion valve may be brought into a fully closed state.

In the above embodiments, an example, in which the evaporation pressure adjustment valve 19 configured by a mechanical mechanism is adopted, has been described, but of course an evaporation pressure adjustment valve configured by an electric mechanism may be adopted. As the evaporation pressure adjustment valve with an electric mechanism, a variable aperture mechanism, having a configuration similar to that of the heating expansion valve 14*a* or the like, can be adopted. Alternatively, a form may be adopted in which the evaporation pressure adjustment valve 19 is not adopted.

In the above embodiments, an example, in which R1234yf is adopted as the refrigerant for the heat pump cycles 10 and 10*a*, has been described, but the present disclosure is not limited thereto. For example, R134a, R600a, R410A, R404A, R32, R407C, or the like may be adopted. Alternatively, a mixed refrigerant obtained by mixing a plurality of kinds of these refrigerants, or the like, may be adopted. Furthermore, carbon dioxide may be adopted as the refrigerant to form a supercritical refrigeration cycle in which the pressure of the high-pressure side refrigerant pressure is equal to or higher than the critical pressure of the refrigerant.

In addition, an example, in which an ethylene glycol aqueous solution is adopted as the low-temperature side heat medium and the high-temperature side heat medium of the above embodiments, has been described, but the present disclosure is not limited thereto. As the high-temperature side heat medium and the low-temperature side heat medium, for example, a solution containing dimethylpolysiloxane, nano-fluid, or the like; an antifreeze; an aqueous liquid medium containing alcohol or the like; or a liquid medium containing oil or the like, may be adopted.

The control mode of the heat pump cycle device according to the present disclosure is not limited to the control modes disclosed in the above embodiments.

In the above embodiments, the vehicle air conditioners 1 and 1*a* capable of executing various operation modes have been described, but it is not necessary to be capable of executing all the above operation modes. If any one of the operation modes in which at least the control process in the hot gas mode is executed, such as (g) the hot gas heating mode, (h) the temperature adjustment hot gas heating mode, or (i) the hot gas dehumidification heating mode, can be executed, the effect of expanding the temperature adjustment range for the heating object can be obtained.

In the above embodiments, an example, in which, when it is determined that frost has been formed in the outdoor heat exchanger 15 during the execution of (c) the parallel dehumidification heating mode, (d) the parallel hot gas dehumidification heating mode is switched to, has been described. However, the present disclosure is not limited thereto. When it is determined that frost has been formed in the outdoor heat exchanger 15 during the execution of (c) the parallel dehumidification heating mode, (i) the hot gas dehumidification heating mode may be switched to. Furthermore, in a case where frost formation in the outdoor heat exchanger 15 progresses even if (d) the parallel hot gas dehumidification heating mode is switched to, (i) the hot gas dehumidification heating mode may be switched to.

In addition, in the above embodiments, an example, in which, when it is determined that frost has been formed in the outdoor heat exchanger 15 during the execution of (e) the outside air heat absorption heating mode, (f) the outside air heat absorption hot gas heating mode is executed, has been described. However, the present disclosure is not limited thereto. When it is determined that frost has been formed in the outdoor heat exchanger 15 during the execution of (e) the outside air heat absorption heating mode, (g) the hot gas heating mode may be switched to. When frost formation in the outdoor heat exchanger 15 progresses eve if (f) the outside air heat absorption hot gas heating mode is switched to, (g) the hot gas heating mode may be switched to.

In the control process in the hot gas mode according to the above embodiments, an example, in which the operations of the compressor 11 and the bypass side flow rate adjustment valve 14*d* are controlled in order to bring the ventilation air temperature TAV close to the target air temperature TAO and bring the sucked refrigerant pressure P close to the target low pressure PSO. However, the present disclosure is not limited thereto.

For example, the control device 60 may control the refrigerant discharge capability of the compressor 11 such that the high-low pressure difference ΔP approaches the target high-low pressure difference ΔPO. In this case, the control device 60 may control the operation of the bypass side flow rate adjustment valve 14*d* such that the sucked refrigerant pressure Ps approaches the target low pressure PSO. Furthermore, the operation of the cooling expansion valve 14*c* may be controlled such that the subcooling degree SC1 approaches the first target subcooling degree SCO1.

For example, the control device 60 may control the operation of the cooling expansion valve 14*c* such that the high-low pressure difference ΔP approaches the target high-low pressure difference ΔPO. In this case, the control device 60 may control the refrigerant discharge capability of the compressor 11 such that the sucked refrigerant pressure Ps approaches the target low pressure PSO. Furthermore, the operation of the bypass side flow rate adjustment valve 14*d* may be controlled such that the subcooling degree SC1 approaches the first target subcooling degree SCO1.

Although the present disclosure has been described in accordance with the embodiments, it is understood that the present disclosure is not limited to the embodiments and the structures. The present disclosure also encompasses various modifications and variations within the scope of equivalents. In addition, various combinations and modes, and other combinations and modes, including only one element, more elements, or less elements, are also within the scope and idea of the present disclosure.

What is claimed is:

1. A heat pump cycle device comprising:

a compressor configured to compress and discharge a refrigerant;

a branch part configured to branch a flow of the refrigerant discharged from the compressor;

a heating unit configured to heat a heating object using one stream of the refrigerants branched at the branch part as a heat source;

a heating-unit side decompression unit configured to decompress the refrigerant flowing out of the heating unit;

a bypass passage that guides the other stream of the refrigerants branched at the branch part to a suction port side of the compressor;

a bypass flow rate adjustment unit configured to adjust a flow rate of the refrigerant flowing through the bypass passage;

a mixing part configured to mix the refrigerant flowing out of the bypass flow rate adjustment unit with the refrigerant flowing out of the heating-unit side decompression unit, and to cause the mixed refrigerant to flow to the suction port side of the compressor; and a controller including a target temperature determination part and a target low-pressure determination part, wherein the target temperature determination part is configured to determine a target temperature that is a target value of an object temperature of the heating object heated by the heating unit, the target low-pressure determination part is configured to determine a target low pressure that is a target value of a sucked refrigerant pressure of the refrigerant to be sucked into the compressor, in a hot gas mode as an operation mode for heating the heating object, the controller controls an operation of at least one of the compressor, the heating-unit side decompression unit, and the bypass flow rate adjustment unit, such that the object temperature approaches the target temperature and the sucked refrigerant pressure approaches the target low pressure, and when the object temperature is lower than the target temperature during execution of the hot gas mode, the controller performs a high-pressure rise control to increase a discharged refrigerant pressure of the refrigerant flowing into the heating unit.

2. The heat pump cycle device according to claim 1, wherein, in the high-pressure rise control, a subcooling degree of the refrigerant flowing out of the heating unit is made higher than that in a normal control of the hot gas mode.

3. The heat pump cycle device according to claim 1, wherein the heating object is a fluid, and in the high-pressure rise control, a flow rate of the heating object to flow into the heating unit is made smaller than that in a normal control in the hot gas mode.

4. The heat pump cycle device according to claim 1, wherein the heating unit includes a high-temperature side heat medium circuit configured to circulate a high-temperature side heat medium, a water-refrigerant heat exchanger configured to exchange heat between the high-temperature side heat medium and the one stream of the refrigerants branched at the branch part, and a heating heat exchanger that exchanges heat between the high-temperature side heat medium and the heating object, and in the high-pressure rise control, a flow rate of the high-temperature side heat medium circulating in the high-temperature side heat medium circuit is made smaller than that in a normal control of the hot gas mode.

5. The heat pump cycle device according to claim 1, wherein in the hot gas mode, the controller controls the operation of at least the compressor such that the object temperature approaches the target temperature and the sucked refrigerant pressure approaches the target low pressure, and the controller performs the high-pressure rise control, when the object temperature is lower than the target temperature and a refrigerant discharge capability of the compressor is equal to or higher than a predetermined reference capability during an execution of the hot gas mode.

6. The heat pump cycle device according to claim 1, wherein in the hot gas mode, the controller controls the operation of at least the bypass flow rate adjustment unit such that the object temperature approaches the target temperature and the sucked refrigerant pressure approaches the target low pressure, and the controller performs the high-pressure rise control, when the object temperature is lower than the target temperature and a throttle opening degree of the bypass flow rate adjustment unit is equal to or lower than a predetermined reference opening degree during execution of the hot gas mode.

7. A heat pump cycle device comprising:

a compressor configured to compress and discharge a refrigerant;

a first joint valve configured to branch a flow of the refrigerant discharged from the compressor;

a heating unit configured to heat a heating object using one stream of the refrigerants branched at the three-way joint as a heat source;

a decompression valve configured to decompress the refrigerant flowing out of the heating unit;

a bypass passage through which the other stream of the refrigerants branched at the first joint valve flows to a suction port side of the compressor while bypassing the heating unit;

a flow rate valve configured to adjust a flow rate of the refrigerant flowing through the bypass passage;

a second joint valve configured to mix the refrigerant flowing out of the flow rate valve with the refrigerant flowing out of the decompression valve, and to cause the mixed refrigerant to flow to the suction port side of the compressor; and a controller including at least one of a circuit and a processor having a memory storing computer program code, wherein the at least one of the circuit and the processor having the memory is configured to: determine a target temperature that is a target value of an object temperature of the heating object heated by the heating unit; and determine a target low pressure that is a target value of a sucked refrigerant pressure of the refrigerant to be sucked into the compressor, in a hot gas mode as an operation mode for heating the heating object, the controller controls an operation of at least one of the compressor, the decompression valve and the flow rate valve, to cause the object temperature to approach the target temperature and to cause the sucked refrigerant pressure to approach the target low pressure, and when the object temperature is lower than the target temperature during execution of the hot gas mode, the controller performs a high-pressure rise control to increase a discharged refrigerant pressure of the refrigerant flowing into the heating unit.

8. The heat pump cycle device according to claim 7, wherein in the hot gas mode, the controller controls the operation of at least the compressor to cause the object temperature to approach the target temperature and to cause the sucked refrigerant pressure to approach the target low pressure, and the controller performs the high-pressure rise control, when the object temperature is lower than the target temperature and a refrigerant discharge capability of the compressor is equal to or higher than a predetermined reference capability during an execution of the hot gas mode.

9. The heat pump cycle device according to claim 7, wherein in the hot gas mode, the controller controls the operation of at least the flow rate valve to cause the object temperature to approach the target temperature and to cause the sucked refrigerant pressure to approach the target low pressure, and the controller performs the high-pressure rise control, when the object temperature is lower than the target temperature and a throttle opening degree of the flow rate valve is equal to or lower than a predetermined reference opening degree during execution of the hot gas mode.

* * * * *